US012163712B2

(12) United States Patent
Yoshimi et al.

(10) Patent No.: US 12,163,712 B2
(45) Date of Patent: Dec. 10, 2024

(54) AIR CONDITIONER

(71) Applicant: DAIKIN INDUSTRIES, LTD., Osaka (JP)

(72) Inventors: Atsushi Yoshimi, Osaka (JP); Takuro Yamada, Osaka (JP); Eiji Kumakura, Osaka (JP); Ikuhiro Iwata, Osaka (JP); Takeru Miyazaki, Osaka (JP)

(73) Assignee: DAIKIN INDUSTRIES, LTD., Osaka (JP)

( * ) Notice: Subject to any disclaimer, the term of this patent is extended or adjusted under 35 U.S.C. 154(b) by 298 days.

(21) Appl. No.: 17/707,550

(22) Filed: Mar. 29, 2022

(65) Prior Publication Data

US 2022/0221196 A1 Jul. 14, 2022

Related U.S. Application Data

(63) Continuation of application No. PCT/JP2020/036084, filed on Sep. 24, 2020.

(30) Foreign Application Priority Data

Sep. 30, 2019 (JP) ..... 2019-180832

(51) Int. Cl.

| | |
|---|---|
| ***F24F 11/65*** | (2018.01) |
| ***F24F 3/06*** | (2006.01) |
| ***F24F 11/84*** | (2018.01) |
| ***F25B 1/10*** | (2006.01) |
| ***F25B 5/02*** | (2006.01) |

(Continued)

(52) U.S. Cl.

CPC ..... *F25B 5/02* (2013.01); *F24F 3/065* (2013.01); *F24F 11/65* (2018.01); *F24F 11/84* (2018.01); *F25B 1/10* (2013.01); *F25B 41/20* (2021.01); *F25B 49/022* (2013.01);

(Continued)

(58) Field of Classification Search

CPC ..... F25B 13/00; F25B 2313/02743; F25B 2313/0231; F25B 2313/0233; F24F 3/065; F24F 11/65; F24F 11/84

See application file for complete search history.

(56) References Cited

U.S. PATENT DOCUMENTS

2011/0005270 A1 1/2011 Yoshimi et al.

FOREIGN PATENT DOCUMENTS

JP 2010-96360 A 4/2010
JP 2010127504 A * 6/2010

(Continued)

OTHER PUBLICATIONS

English translation of International Preliminary Report on Patentability and Written Opinion of the International Searching Authority for International Application No. PCT/JP2020/036084, dated Apr. 14, 2022.

(Continued)

*Primary Examiner* — Eric S Ruppert
(74) *Attorney, Agent, or Firm* — Birch, Stewart, Kolasch & Birch, LLP

(57) ABSTRACT

A heat-source-side heat exchanger is divided so that a heat-source-side heat exchanger that functions as an evaporator also functions as an intermediate cooler. Since, when an air conditioner includes a bypass pipe, a heat-source-side heat exchanger that functions as an evaporator and as an intermediate cooler also further functions as a radiator, operation efficiency is increased.

14 Claims, 12 Drawing Sheets

(51) Int. Cl.
*F25B 41/20* (2021.01)
*F25B 49/02* (2006.01)

(52) U.S. Cl.
CPC ..... *F25B 2313/0231* (2013.01); *F25B 2313/0233* (2013.01); *F25B 2313/02743* (2013.01)

(56) References Cited

FOREIGN PATENT DOCUMENTS

| | | | | |
|---|---|---|---|---|
| JP | 2010-156493 | A | 7/2010 | |
| JP | 2013-92369 | A | 5/2013 | |
| JP | 5239824 | B2 | 7/2013 | |
| JP | 2016-11780 | A | 1/2016 | |
| WO | WO-2013004972 | A1 * | 1/2013 | ..... F25B 1/10 |

OTHER PUBLICATIONS

International Search Report issued in PCT/JP2020/036084, mailed on Dec. 1, 2020.
Written Opinion issued in PCT/JP2020/036084, mailed on Dec. 1, 2020.
Extended European Search Report for European Application No. 20870617.6 dated Oct. 5, 2022.

* cited by examiner

AIR CONDITIONER

CROSS REFERENCE TO RELATED APPLICATIONS

This application is a Continuation of PCT International Application No. PCT/JP2020/036084, filed on Sep. 24, 2020, which claims priority under 35 U.S.C. 119(a) to Patent Application No. 2019-180832, filed in Japan on Sep. 30, 2019, all of which are hereby expressly incorporated by reference into the present application.

TECHNICAL FIELD

The present disclosure relates to an air conditioner.

BACKGROUND ART

Hitherto, as an example of an air conditioner that has a refrigerant circuit constituted to be switchable between a cooling operation and a heating operation and that performs a multistage compression refrigeration cycle, there exists an air conditioner such as that described in PTL 1 (Japanese Unexamined Patent Application Publication No. 2016-11780). In such an air conditioner, increasing operation efficiency by cooling with an intermediate cooler a high-temperature refrigerant that has been subjected to multistage compression may be considered.

SUMMARY

An air conditioner according to a first aspect includes a compression mechanism, a heat-source-side unit, a plurality of use-side units, and a control unit. The compression mechanism has a first compression unit and a second compression unit that is disposed on a discharge side of the first compression unit. The heat-source-side unit has a first heat-source-side heat exchanger and a second heat-source-side heat exchanger. The plurality of use-side units switches between a cooling operation and a heating operation. The control unit performs switching between a first operation, a second operation, and a third operation by switching a flow of a refrigerant at the heat-source-side unit. The control unit, at a time of the first operation, switches the flow of the refrigerant so that the first heat-source-side heat exchanger functions as a radiator and the second heat-source-side heat exchanger functions as an intermediate cooler. The control unit, at a time of the second operation, switches the flow of the refrigerant so that the first heat-source-side heat exchanger and the second heat-source-side heat exchanger function as evaporators. The control unit, at a time of the third operation, switches the flow of the refrigerant so that the first heat-source-side heat exchanger functions as the radiator and the second heat-source-side heat exchanger functions as the evaporator. Alternatively, the control unit, at the time of the third operation, switches the flow of the refrigerant so that the first heat-source-side heat exchanger functions as the evaporator and the second heat-source-side heat exchanger functions as a radiator.

DESCRIPTION OF EMBODIMENTS

An air conditioner according to an embodiment of the present disclosure is described below with reference to the drawings. Note that embodiments and modifications below are specific examples of the present disclosure, do not limit the technical scope of the present disclosure, and are changeable as appropriate within a scope that does not depart from the spirit.

First Embodiment (1) Overall Structure

Figure 1:
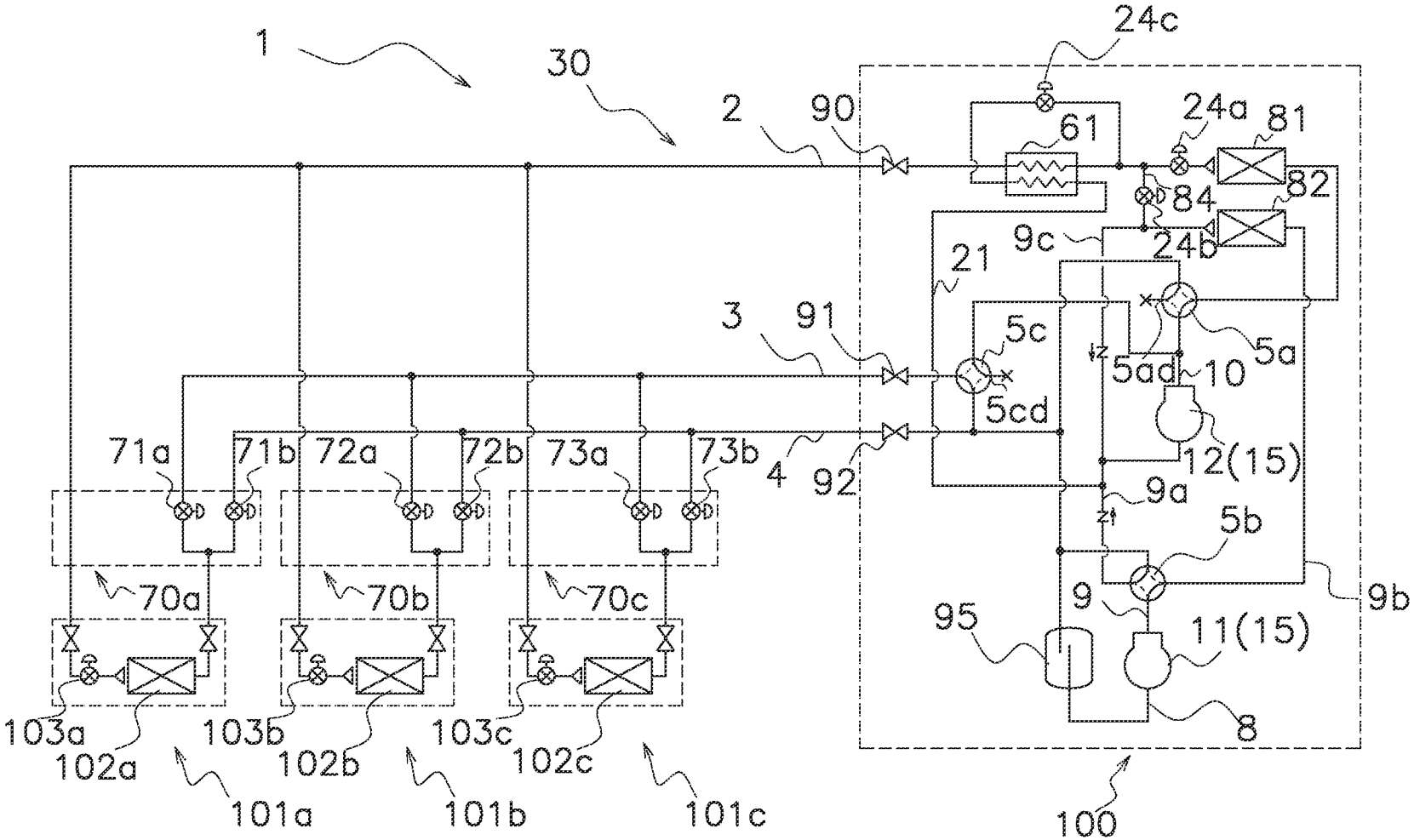
FIG. 1 is a schematic structural view of an air conditioner 1 according to a first embodiment of the present disclosure.

FIG. 1 is a schematic structural view of an air conditioner 1 according to a first embodiment of the present disclosure. In the air conditioner 1, a refrigerant circuit 30 is constituted by a compression mechanism 15, a heat-source-side unit 100, a plurality of use-side units 101*a*, 101*b*, and 101*c*, branch units 70*a*, 70*b*, and 70*c*, and a control unit 120. The air conditioner 1 is constituted to be capable of freely selecting between a cooling operation and a heating operation for each use-side unit. A refrigerant that acts in a supercritical region (here, a $CO_2$ refrigerant or a $CO_2$ mixed refrigerant) is sealed in the refrigerant circuit 30.

(2) Detailed Structure (2-1) Compression Mechanism

The compression mechanism 15 has a first compression unit 11 and a second compression unit 12. The compression mechanism 15 sucks in a low-pressure refrigerant in a refrigeration cycle by a suction pipe 8, and compresses the refrigerant by the first compression unit 11 and the second compression unit 12. The low-pressure refrigerant in the refrigeration cycle, after being compressed to an intermediate pressure in the refrigeration cycle by the first compression unit 11, is discharged to an intermediate connection pipe 9. The refrigerant that has been discharged to the intermediate connection pipe 9 is sucked into the second compression unit 12. The refrigerant that has been sucked into the second compression unit 12, after being compressed to a high pressure in the refrigeration cycle, is discharged to a discharge pipe 10.

The intermediate connection pipe 9 is a pipe to which the refrigerant compressed to the intermediate pressure in the refrigeration cycle at the first compression unit 11 is discharged. The intermediate connection pipe 9 is connected to a second intermediate-connection-pipe branch pipe 9*b* and a first intermediate-connection-pipe branch pipe 9*a* via a second heat-source-side switching mechanism 5*b*. The second intermediate-connection-pipe branch pipe 9*b* is a pipe that connects the intermediate connection pipe 9 and a second heat-source-side heat exchanger 82 to each other via the second heat-source-side switching mechanism 5*b*. The first intermediate-connection-pipe branch pipe 9*a* is a pipe that connects the intermediate connection pipe 9 and the second compression unit 12 to each other via the second heat-source-side switching mechanism 5*b*.

The discharge pipe 10 is a pipe to which the refrigerant compressed to the high pressure in the refrigeration cycle by the second compression unit 12 is discharged. The discharge pipe 10 branches into a high-low-pressure gas-refrigerant connection pipe 3 and a liquid-refrigerant connection pipe 2.

(2-2) Heat-Source-Side Unit

The heat-source-side unit 100 is installed on the roof of, for example, a building, or around, for example, a building. The heat-source-side unit 100 is connected to the use-side units 101*a*, 101*b*, and 101*c* via the liquid-refrigerant connection pipe 2, the high-low-pressure gas-refrigerant connection pipe 3, a low-pressure gas-refrigerant connection pipe 4, a liquid-side cutout valve 90, a first gas-side cutout valve 91, a second gas-side cutout valve 92, and the respective branch units 70*a*, 70*b*, and 70*c*, and constitutes a part of the refrigerant circuit 30.

The heat-source-side unit 100 primarily has a first heat-source-side heat exchanger 81, the second heat-source-side heat exchanger 82, a pipe 9*c* for sending to a suction side of the second compression unit (hereunder, injection pipe 9*c*), an economizer pipe 21, an economizer heat exchanger 61, a first heat-source-side expansion mechanism 24*a*, a second heat-source-side expansion mechanism 24*b*, a first heat-source-side switching mechanism 5*a*, the second heat-source-side switching mechanism 5*b*, a third heat-source-side switching mechanism 5*c*, and an accumulator 95.

(2-2-1)

A heat-source-side heat exchanger is a heat exchanger that performs heat exchange between, for example, a refrigerant and outdoor air, and, here, is divided into the first heat-source-side heat exchanger 81 and the second heat-source-side heat exchanger 82. The first heat-source-side heat exchanger 81 is a heat exchanger that functions as an evaporator or a radiator of a refrigerant. The first heat-source-side heat exchanger 81 is connected to the first heat-source-side switching mechanism 5*a* by the liquid-refrigerant connection pipe 2. The second heat-source-side heat exchanger 82 is a heat exchanger that functions as an intermediate cooler or an evaporator of a refrigerant. The second heat-source-side heat exchanger 82 is connected to the second heat-source-side switching mechanism 5*b* by the second intermediate-connection-pipe branch pipe 9*b*. A liquid side of the first heat-source-side heat exchanger 81 and a liquid side of the second heat-source-side heat exchanger 82 are connected to each other via a liquid-refrigerant-connection-pipe branch pipe 84.

The injection pipe 9*c* is a pipe that causes an intermediate-pressure refrigerant in the refrigeration cycle that has flowed from the second heat-source-side heat exchanger 82 that functions as an intermediate cooler to return to the second compression unit 12.

The economizer pipe 21 is a pipe that branches off from the liquid-refrigerant connection pipe 2 and merges with the first intermediate-connection-pipe branch pipe 9*a*. The economizer pipe 21 includes a third heat-source-side expansion mechanism 24*c*. Here, the third heat-source-side expansion mechanism 24*c* is constituted by an electric expansion valve whose opening degree can be adjusted. The opening degree of the third heat-source-side expansion mechanism 24*c* is adjusted as appropriate by the control unit 120 in accordance with an operation state.

The economizer heat exchanger 61 is a heat exchanger that is disposed between the heat-source-side unit 100 and the use-side units 101*a*, 101*b*, and 101*c*. Here, the economizer heat exchanger 61 is a double-pipe-type heat exchanger or a plate-type heat exchanger. A refrigerant that flows in the economizer pipe 21 and a refrigerant that flows in the liquid-refrigerant connection pipe 2 exchange heat with each other at the economizer heat exchanger 61. A refrigerant that has radiated at the first heat-source-side heat exchanger 81 that functions as a radiator of the refrigerant further radiates and is subcooled at the economizer heat exchanger 61.

The first heat-source-side expansion mechanism 24*a* and the second heat-source-side expansion mechanism 24*b* are mechanisms that are disposed at the refrigerant circuit 30 and that expand a refrigerant that flows between the use-side heat exchangers 102*a*, 102*b*, and 102*c* and the heat-source-side heat exchangers 81 and 82. Here, the first heat-source-side expansion mechanism 24*a* and the second heat-source-side expansion mechanism 24*b* are each constituted by an electric expansion valve whose opening degree can be adjusted. The opening degree of the first heat-source-side expansion mechanism 24*a* and the opening degree of the second heat-source-side expansion mechanism 24*b* are each adjusted as appropriate by the control unit 120 in accordance with an operation state.

The first heat-source-side switching mechanism 5*a*, the second heat-source-side switching mechanism 5*b*, and the third heat-source-side switching mechanism 5*c* are mechanisms for switching a direction of flow of a refrigerant in the refrigerant circuit 30. More specifically, the control unit 120 is a mechanism for switching between a radiation operation state and an evaporation operation state. The radiation operation state is a state in which the control unit 120 causes the first heat-source-side heat exchanger 81 to function as a radiator and the second heat-source-side heat exchanger 82 to function as a radiator or an intermediate cooler of a refrigerant. The evaporation operation state is a state in which the control unit 120 causes the first heat-source-side heat exchanger 81 and the second heat-source-side heat exchanger 82 to function as evaporators of a refrigerant.

Here, the first heat-source-side switching mechanism 5*a*, the second heat-source-side switching mechanism 5*b*, and the third heat-source-side switching mechanism 5*c* are each a four-way switching valve. Note that a fourth port 5*ad* of the first heat-source-side switching mechanism 5*a* and a fourth port 5*cd* of the third heat-source-side switching mechanism 5*c* are closed, and the first heat-source-side switching mechanism 5*a* and the third heat-source-side switching mechanism 5*c* each function as a three-way valve.

(2-3) Use-Side Units

The use-side units 101*a*, 101*b*, and 101*c* are installed on a ceiling inside, for example, a building by being embedded, suspended, or the like, or are installed on an indoor wall surface by wall hanging or the like. The use-side units 101*a*, 101*b*, and 101*c* are connected to the heat-source-side unit 100 via the liquid-refrigerant connection pipe 2, the high-low-pressure gas-refrigerant connection pipe 3, the low-pressure gas-refrigerant connection pipe 4, the liquid-side cutout valve 90, a first gas-side cutout valve 91, the second gas-side cutout valve 92, and the respective branch units 70*a*, 70*b*, and 70*c*; and constitute a part of the refrigerant circuit 30.

The first use-side unit 101*a* has a first use-side heat exchanger 102*a* and a first use-side expansion mechanism 103*a*. The second use-side unit 101*b* has a second use-side heat exchanger 102*b* and a second use-side expansion mechanism 103*b*. The third use-side unit 101*c* has a third use-side heat exchanger 102*c* and a third use-side expansion mechanism 103*c*. The use-side heat exchangers 102*a*, 102*b*, and 102*c* are each a heat exchanger that processes indoor air-conditioning load (heat load) by causing a refrigerant and indoor air to exchange heat with each other. Here, the use-side expansion mechanisms 103*a*, 103*b*, and 103*c* are each constituted by an electric expansion valve. The opening degrees of the use-side expansion mechanisms 103*a*, 103*b*, and 103*c* are each adjusted as appropriate by the control unit 120 in accordance with an operation state.

Note that, although, in the present embodiment, the air conditioner 1 including three use-side units 101*a*, 101*b*, and 101*c* is described, the present disclosure is also applicable to an air conditioner including a larger number of use-side units than three use-side units.

(2-4) Branch Units

The branch units 70*a*, 70*b*, and 70*c* are installed, for example, near the use-side units 101*a*, 101*b*, and 101*c*, respectively, inside, for example, a building. The branch units 70*a*, 70*b*, and 70*c* are interposed between the liquid-refrigerant connection pipe 2, the high-low-pressure gas-refrigerant connection pipe 3, and the low-pressure gas-refrigerant connection pipe 4, the use-side units 101*a*, 101*b*, and 101*c* and the heat-source-side unit 100; and constitute a part of the refrigerant circuit 30. The branch units 70*a*, 70*b*, and 70*c* are installed at a corresponding one of the use-side units 101*a*, 101*b*, and 101*c*. Alternatively, a plurality of use-side units each having the same switching timing between a cooling operation and a heating operation are connected to one branch unit.

The branch units 70*a*, 70*b*, and 70*c* each primarily have a first branch path including a corresponding one of first branch-unit switching valves 71*a*, 72*a*, and 73*a*, and a second branch path including a corresponding one of second branch-unit switching valves 71*b*, 72*b*, and 73*b*. The first branch-unit switching valves 71*a*, 72*a*, and 73*a* are each an electromagnetic valve that switches communication/non-communication between the high-low-pressure gas-refrigerant connection pipe 3 and a corresponding one of the use-side heat exchangers 102*a*, 102*b*, and 102*c*. The second branch-unit switching valves 71*b*, 72*b*, and 73*b* are each an electromagnetic valve that switches communication/non-communication between the low-pressure gas-refrigerant connection pipe 4 and a corresponding one of the use-side heat exchangers 102*a*, 102*b*, and 102*c*.

(2-5) Control Unit

Figure 2:
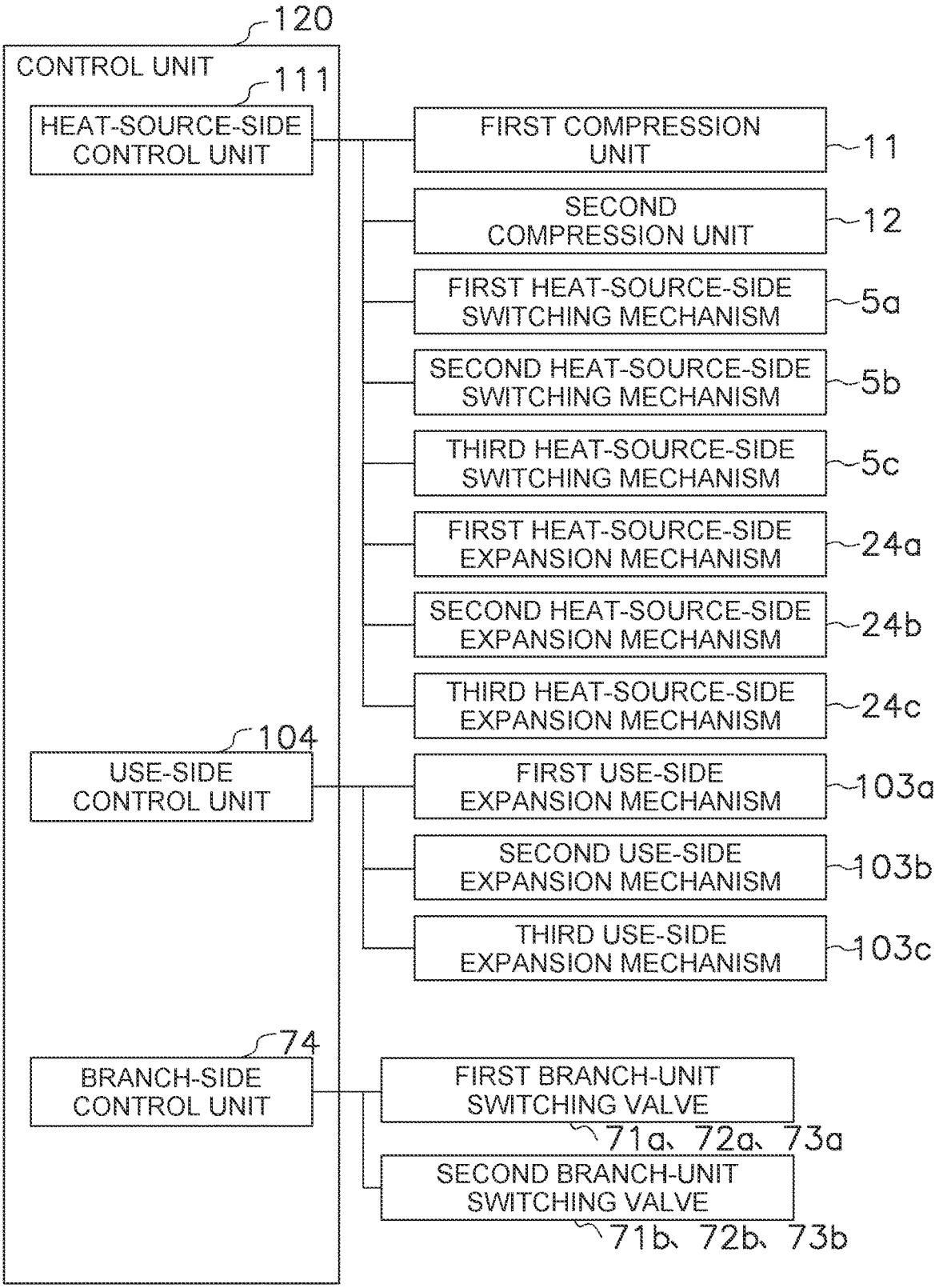
FIG. 2 is a block diagram of a control unit 120 according to the first embodiment of the present disclosure.

The control unit 120 controls the operations of devices of each part that constitutes the air conditioner 1. The control unit 120 is constituted by joining a heat-source-side control unit 111, a use-side control unit 104, and a branch-side control unit 74 by a communication line (see FIG. 2).

The heat-source-side unit 100 has the heat-source-side control unit 111 that controls the operation of each part that constitutes the heat-source-side unit 100. The heat-source-side control unit 111 includes a microcomputer and various electric components, which are provided for controlling the heat-source-side unit 100, the microcomputer having a CPU (Central Processing Unit), a memory, and the like. The CPU reads a program that is stored in the memory or the like and performs a predetermined calculation in accordance with the program. Further, in accordance with the program, the CPU is capable of writing a calculated result to the memory and reading information stored in the memory. The heat-source-side control unit 111 is constituted to be capable of exchanging a control signal or the like with the use-side control unit 104 of the use-side units 101*a*, 101*b*, and 101*c* via the communication line.

The use-side units 101*a*, 101*b*, and 101*c* have the use-side control unit 104 that controls the operation of each part that constitutes the use-side units 101*a*, 101*b*, and 101*c*. The use-side control unit 104 includes a microcomputer and various electric components, which are provided for controlling the use-side units 101*a*, 101*b*, and 101*c*, the microcomputer having a CPU (Central Processing Unit), a memory, and the like. The CPU reads a program that is stored in the memory or the like and performs a predetermined calculation in accordance with the program. Further, in accordance with the program, the CPU is capable of writing a calculated result to the memory and reading information stored in the memory. The use-side control unit 104 is constituted to be capable of exchanging a control signal or the like with the heat-source-side unit 100 via the communication line. The use-side control unit 104 is constituted to be capable of receiving, for example, signals regarding the operation and the stoppage of the air conditioner 1, and signals related to various settings, the signals being sent from a remote controller (not shown) for operating the use-side units 101*a*, 101*b*, and 101*c*.

The branch units 70*a*, 70*b*, and 70*c* have the branch-side control unit 74 that controls the operation of each part that constitutes the branch units 70*a*, 70*b*, and 70*c*. The branch-side control unit 74 includes a microcomputer and various electric components, which are provided for controlling the branch units 70*a*, 70*b*, and 70*c*, the microcomputer having a CPU (Central Processing Unit), a memory, and the like. The CPU reads a program that is stored in the memory or the like and performs a predetermined calculation in accordance with the program. Further, in accordance with the program, the CPU is capable of writing a calculated result to the memory and reading information stored in the memory. The branch-side control unit 74 is constituted to be capable of exchanging a control signal or the like with the use-side control unit 104 of the use-side units 101*a*, 101*b*, and 101*c*.

Structural devices of the air conditioner 1 that is controlled by the control unit 120 includes, for example, the compression units 11 and 12, the heat-source-side switching mechanisms 5*a*, 5*b*, and 5*c*, the heat-source-side expansion mechanisms 24*a*, 24*b*, and 24*c*, the use-side expansion mechanisms 103*a*, 103*b*, and 103*c*, the first branch-unit switching valves 71*a*, 72*a*, and 73*a*, and the second branch-unit switching valves 71*b*, 72*b*, and 73*b*.

The air conditioner 1 is capable of performing switching between a first operation, a second operation, and a third operation, which are described below, by control of the control unit 120.

Specifically, when switching the operation of each use-side unit, the control unit 120 switches the states of the heat-source-side heat exchangers 81 and 82 from the difference between the total of operating-device capacities of the use-side heat exchangers that function as evaporators of a refrigerant and the total of operating-device capacities of the use-side heat exchangers that function as radiators of a refrigerant.

When ΔQ=the operating-device capacities of the use-side heat exchangers that function as evaporators of a refrigerant—the operating-device capacities of the use-side heat exchangers that function as radiators of a refrigerant, if ΔQ is larger than a first threshold value c1, the control unit 120 causes the first heat-source-side heat exchanger 81 and the second heat-source-side heat exchanger 82 to function as radiators of a refrigerant.

If ΔQ is less than or equal to the first threshold value c1 and is greater than or equal to a second threshold value c2, the control unit 120 causes the first heat-source-side heat exchanger 81 to be a radiator and the second heat-source-side heat exchanger 82 to be an evaporator.

If ΔQ is less than the second threshold value c2, the control unit 120 causes the first heat-source-side heat exchanger 81 and the second heat-source-side heat exchanger 82 to function as evaporators of a refrigerant.

When a state in which both the high pressure and the low pressure of the user-side heat exchangers during the operation are lower than a target pressure Pb has continued for a predetermined time, the control unit 120 increases the number of heat-source-side heat exchangers that function as evaporators.

When a state in which both the high pressure and the low pressure of the user-side heat exchangers during the operation are higher than the target pressure Pb has continued for a predetermined time, the control unit 120 increases the number of heat-source-side heat exchangers that function as radiators.

(3) Operation of Air Conditioner

Next, the operation of the air conditioner 1 according to the present embodiment is described. The air conditioner 1 according to the present embodiment conditions air due to the control unit 120 performing switching between the first operation, the second operation, and the third operation.

The first operation is an operation in which only use-side heat exchangers that function as evaporators of a refrigerant (use-side units that perform a cooling operation) exist (all cooling operation).

The second operation is an operation in which only use-side heat exchangers that function as radiators of a refrigerant (use-side units that perform a heating operation) exist (all heating operation).

The third operation is an operation in which a use-side unit that performs a cooling operation and a use-side unit that performs a heating operation exist (simultaneous cooling-and-heating operation). The third operation includes a third A operation, a third B operation, and a third C operation.

The third A operation is an operation in which, although both a use-side heat exchanger that functions as an evaporator of a refrigerant and a use-side heat exchanger that functions as a radiator of a refrigerant exist, the load on an evaporation side is large as a whole (predominant cooling operation).

The third B operation is an operation in which, although both a use-side heat exchanger that functions as a radiator of a refrigerant and a use-side heat exchanger that functions as an evaporator of a refrigerant exist, the load on a radiation side is large as a whole (predominant heating operation).

The third C operation is an operation in which, although both a use-side heat exchanger that functions as an evaporator of a refrigerant and a use-side heat exchanger that functions as a radiator of a refrigerant exist, an evaporation load and a radiation load are equal to each other as a whole (equivalent cooling-heating operation).

(3-1) First Operation

Figure 3:
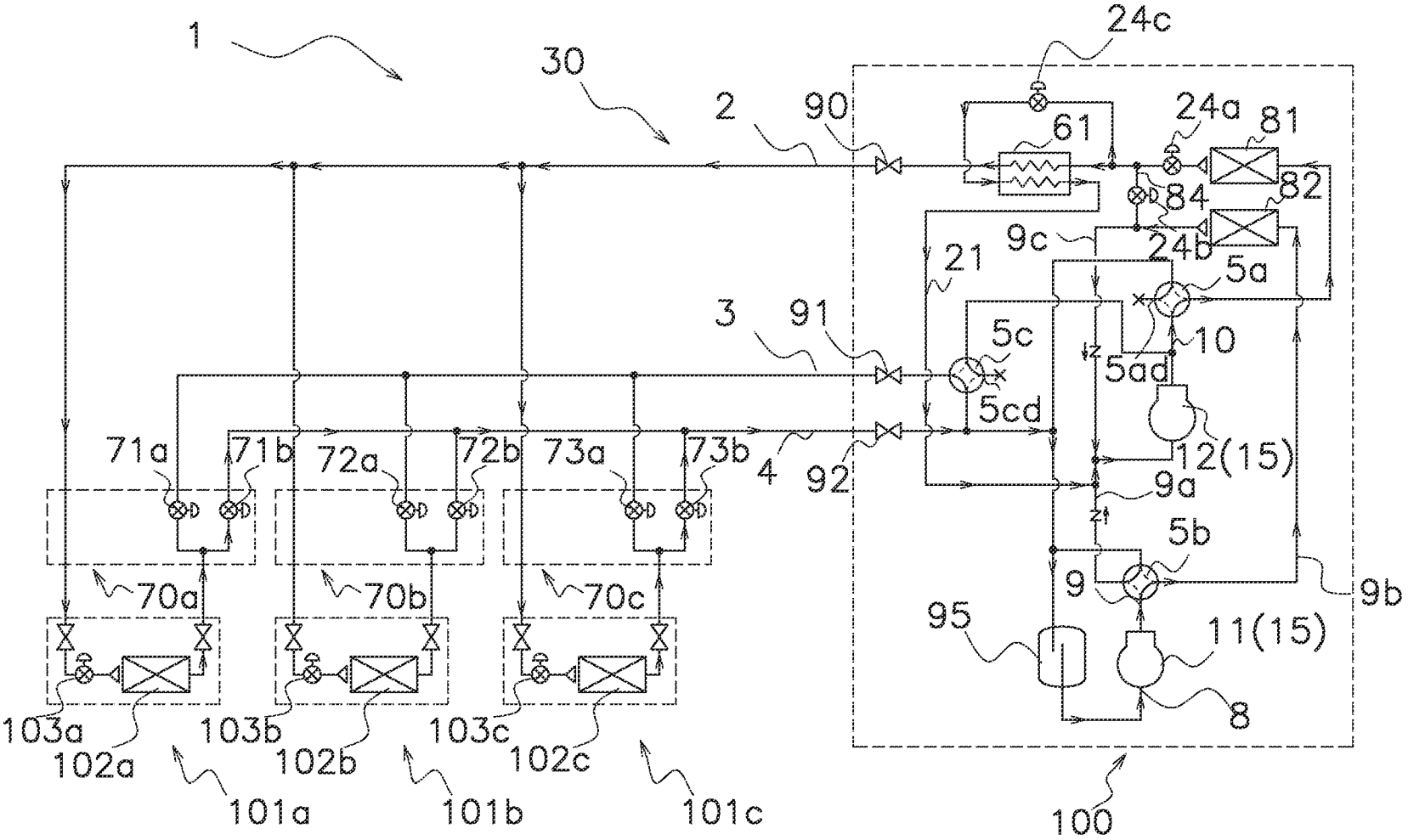
FIG. 3 is a schematic structural explanatory view of the operation of the air conditioner 1 when a first operation is performed.

Here, operations that are performed when the first operation is performed are described by giving as an example a case in which the control unit 120 causes the first use-side heat exchanger 102*a* and the third use-side heat exchanger 102*c* to function as evaporators of a refrigerant and perform a cooling operation and in which the control unit 120 causes the operation of the second use-side heat exchanger 102*b* to be stopped (see FIG. 3).

In the first operation, the control unit 120 determines that the first heat-source-side heat exchanger 81 is to function as a radiator of a refrigerant and the second heat-source-side heat exchanger 82 is to function as an intermediate cooler of a refrigerant. The control unit 120 switches the first heat-source-side switching mechanism 5*a*, the second heat-source-side switching mechanism 5*b*, and the third heat-source-side switching mechanism 5*c* to a radiation operation state (state shown by the solid lines of the first heat-source-side switching mechanism 5*a*, the second heat-source-side switching mechanism 5*b*, and the third heat-source-side switching mechanism 5*c* in FIG. 3). The control unit 120 closes the first branch-unit switching valves 71*a*, 72*a*, and 73*a* and the second branch-unit switching valve 72*b*, and opens the second branch-unit switching valves 71*b* and 73*b*.

In such a state of the refrigerant circuit 30 (regarding flow of a refrigerant, see the arrows at the refrigerant circuit 30 of FIG. 3), a low-pressure refrigerant in a refrigeration cycle is sucked into the first compression unit 11 from the suction pipe 8. The low-pressure refrigerant in the refrigeration cycle that has been sucked into the first compression unit 11, after being compressed to an intermediate pressure in the refrigeration cycle at the first compression unit 11, is discharged to the intermediate connection pipe 9. The intermediate-pressure refrigerant in the refrigeration cycle that has been discharged to the intermediate connection pipe 9 from the first compression unit 11 flows through the second intermediate-connection-pipe branch pipe 9*b* via the second heat-source-side switching mechanism 5*b*, and is sent to the second heat-source-side heat exchanger 82 that functions as an intermediate cooler. The refrigerant that has been sent to the second heat-source-side heat exchanger 82 that functions as an intermediate cooler exchanges heat with, for example, outdoor air and is cooled at the second heat-source-side heat exchanger 82. The intermediate-pressure refrigerant in the refrigeration cycle that has been cooled at the second heat-source-side heat exchanger 82 is sent to the second compression unit 12 via the injection pipe 9*c* and the first intermediate-connection-pipe branch pipe 9*a*. The intermediate-pressure refrigerant in the refrigeration cycle that has been sent to the second compression unit 12 is sucked into the second compression unit 12 and is compressed to a high pressure in the refrigeration cycle at the second compression unit 12. The refrigerant that has been compressed to a high pressure in the refrigeration cycle at the second compression unit 12 is discharged to the discharge pipe 10. Here, the high-pressure refrigerant in the refrigeration cycle that has been discharged to the discharge pipe 10 from the second compression unit 12 is compressed to a pressure that is higher than the critical pressure of the refrigerant by a double-stage compression operation by the compression units 11 and 12. The high-pressure refrigerant in the refrigeration cycle that has been discharged to the discharge pipe 10 from the second compression unit 12 flows through the liquid-refrigerant connection pipe 2 and is sent to the first heat-source-side heat exchanger 81 that functions as a radiator. The high-pressure refrigerant in the refrigeration cycle that has been sent to the first heat-source-side heat exchanger 81 exchanges heat with, for example, outdoor air and radiates at the first heat-source-side heat exchanger 81, and is sent to the first heat-source-side expansion mechanism 24*a*. The high-pressure refrigerant in the refrigeration cycle that has been sent to the first heat-source-side expansion mechanism 24*a* has its pressure reduced at the first heat-source-side expansion mechanism 24*a* and is sent to the economizer heat exchanger 61 via the liquid-refrigerant connection pipe 2. At this time, a part of the refrigerant that flows in the liquid-refrigerant connection pipe 2 branches and flows in the economizer pipe 21.

The refrigerant that has branched and that has flowed in the economizer pipe 21 from the liquid-refrigerant connection pipe 2 has its pressure reduced to an intermediate pressure in the refrigeration cycle at the third heat-source-side expansion mechanism 24*c*, and is sent to the economizer heat exchanger 61. The refrigerant whose pressure has been reduced to an intermediate pressure in the refrigeration cycle at the third heat-source-side expansion mechanism 24*c* exchanges heat with the refrigerant that flows in the liquid-refrigerant connection pipe 2 at the economizer heat exchanger 61. The intermediate-pressure refrigerant in the refrigeration cycle that has exchanged heat with the refrigerant that flows in the liquid-refrigerant connection pipe 2 at the economizer heat exchanger 61 is sent to the first intermediate-connection-pipe branch pipe 9*a*. The intermediate-pressure refrigerant in the refrigeration cycle that has been sent to the first intermediate-connection-pipe branch pipe 9*a* is sucked into the second compression unit 12.

The refrigerant whose pressure has been reduced at the first heat-source-side expansion mechanism 24*a* and that has been sent to the economizer heat exchanger 61 via the liquid-refrigerant connection pipe 2 exchanges heat with the refrigerant that flows in the economizer pipe 21 and is cooled at the economizer heat exchanger 61. The refrigerant that has been cooled at the economizer heat exchanger 61 is sent to the use-side expansion mechanisms 103*a* and 103*c* via the liquid-refrigerant connection pipe 2. The refrigerant that has been sent to the use-side expansion mechanisms 103*a* and 103*c* via the liquid-refrigerant connection pipe 2 has its pressure reduced and becomes a low-pressure refrigerant in a gas-liquid two-phase state in the refrigeration cycle at the use-side expansion mechanisms 103*a* and 103*c*. The low-pressure refrigerant in the refrigeration cycle whose pressure has been reduced at the use-side expansion mechanisms 103*a* and 103*c* is sent to the use-side heat exchangers 102*a* and 102*c*. The low-pressure refrigerant in the refrigeration cycle that has been sent to the use-side heat exchangers 102*a* and 102*c* exchanges heat with, for example, indoor air and evaporates at the use-side heat exchangers 102*a* and 102*c* that function as evaporators of the refrigerant. The low-pressure refrigerant in the refrigeration cycle that has evaporated at the use-side heat exchangers 102*a* and 102*c* is sucked into the first compression unit 11 again via the low-pressure gas-refrigerant connection pipe 4, the accumulator 95, and the suction pipe 8. In this way, the first operation is performed.

(3-2) Second Operation

Figure 4:
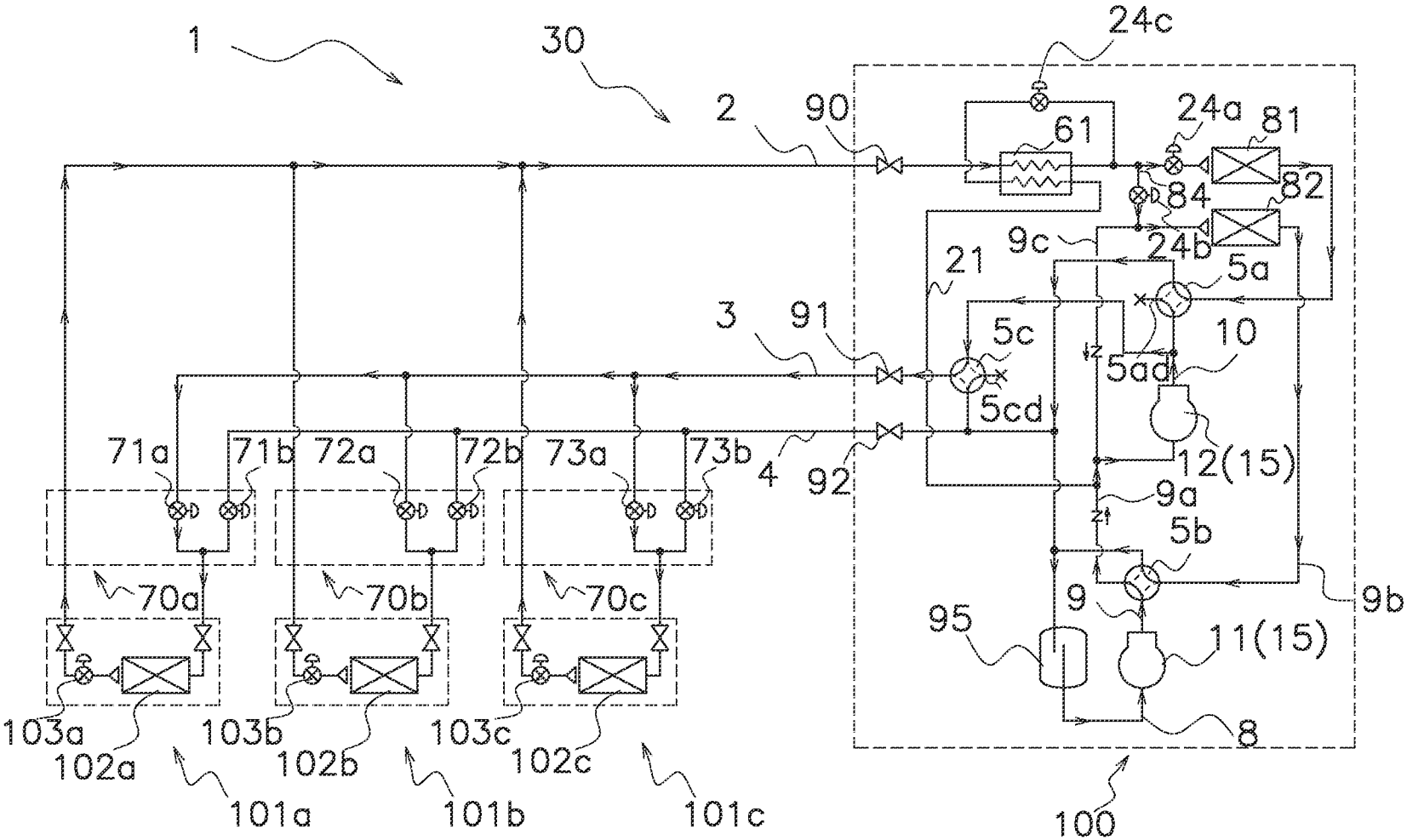
FIG. 4 is a schematic structural explanatory view of the operation of the air conditioner 1 when a second operation is performed.

Here, operations that are performed when the second operation is performed are described by giving as an example a case in which the control unit 120 causes the first use-side heat exchanger 102*a* and the third use-side heat exchanger 102*c* to function as radiators of a refrigerant and perform a heating operation and in which the control unit 120 causes the operation of the second use-side heat exchanger 102*b* to be stopped (see FIG. 4).

In the second operation, the control unit 120 determines that the first heat-source-side heat exchanger 81 and the second heat-source-side heat exchanger 82 are to function as evaporators of a refrigerant. The control unit 120 switches the first heat-source-side switching mechanism 5*a*, the second heat-source-side switching mechanism 5*b*, and the third heat-source-side switching mechanism 5*c* to an evaporation operation state (state shown by the solid lines of the first heat-source-side switching mechanism 5*a*, the second heat-source-side switching mechanism 5*b*, and the third heat-source-side switching mechanism 5*c* in FIG. 4). The control unit 120 closes the first branch-unit switching valve 72*a* and the second branch-unit switching valves 71*b*, 72*b*, and 73*b* and opens the first branch-unit switching valves 71*a* and 73*a*.

In such a state of the refrigerant circuit 30 (regarding flow of a refrigerant, see the arrows at the refrigerant circuit 30 of FIG. 4), a low-pressure refrigerant in a refrigeration cycle is sucked into the first compression unit 11 from the suction pipe 8. The low-pressure refrigerant in the refrigeration cycle that has been sucked into the first compression unit 11, after being compressed to an intermediate pressure in the refrigeration cycle at the first compression unit 11, is discharged to the intermediate connection pipe 9. The intermediate-pressure refrigerant in the refrigeration cycle that has been discharged to the intermediate connection pipe 9 from the first compression unit 11 flows through the first intermediate-connection-pipe branch pipe 9*a* via the second heat-source-side switching mechanism 5*b*, and is sucked into the second compression unit 12. The refrigerant sucked into the second compression unit 12, after being compressed to a high pressure in the refrigeration cycle at the second compression unit 12, is discharged to the discharge pipe 10. Here, the high-pressure refrigerant in the refrigeration cycle that has been discharged from the second compression unit 12 is compressed to a pressure that is higher than the critical pressure of the refrigerant by a double-stage compression operation by the compression units 11 and 12. The high-pressure refrigerant in the refrigeration cycle that has been discharged from the second compression unit 12 is sent to the use-side heat exchangers 102*a* and 102*c* via the high-low-pressure gas-refrigerant connection pipe 3 and the third heat-source-side switching mechanism 5*c*. The high-pressure refrigerant in the refrigeration cycle that has been sent to the use-side heat exchangers 102*a* and 102*c* exchanges heat with, for example, indoor air and radiates at the use-side heat exchangers 102*a* and 102*c* that function as radiators of the refrigerant. The high-pressure refrigerant in the refrigeration cycle that has radiated at the use-side heat exchangers 102*a* and 102*c* is sent to the use-side expansion mechanisms 103*a* and 103*c*. The high-pressure refrigerant in the refrigeration cycle that has been sent to the use-side expansion mechanisms 103*a* and 103*c* has its pressure reduced at the use-side heat expansion mechanisms 103*a* and 103*c*. The refrigerant whose pressure has been reduced at the use-side expansion mechanisms 103*a* and 103*c* is sent to the first heat-source-side expansion mechanism 24*a* and the second heat-source-side expansion mechanism 24*b* via the liquid-refrigerant connection pipe 2 or the liquid-refrigerant connection-pipe branch pipe 84. The refrigerant that has been sent to the first heat-source-side expansion mechanism 24*a* and the second heat-source-side expansion mechanism 24*b* has its pressure reduced and becomes a low-pressure refrigerant in a gas-liquid two-phase state in the refrigeration cycle at the first heat-source-side expansion mechanism 24*a* and the second heat-source-side expansion mechanism 24*b*. The low-pressure refrigerant in the refrigeration cycle whose pressure has been reduced at the first heat-source-side expansion mechanism 24*a* and the second heat-source-side expansion mechanism 24*b* is sent to the first heat-source-side heat exchanger 81 and the second heat-source-side heat exchanger 82. The low-pressure refrigerant in the refrigeration cycle that has been sent to the first heat-source-side heat exchanger 81 and the second heat-source-side heat exchanger 82 exchanges heat with, for example, outdoor air and evaporates at the first heat-source-side heat exchanger 81 and the second heat-source-side heat exchanger 82 that function as evaporators of the refrigerant. The low-pressure refrigerant in the refrigeration cycle that has evaporated at the first heat-source-side heat exchanger 81 is sucked into the first compression unit 11 again via the first heat-source-side switching mechanism 5*a*, the accumulator 95, and the suction pipe 8. The low-pressure refrigerant in the refrigeration cycle that has evaporated at the second heat-source-side heat exchanger 82 is sucked into the first compression unit 11 again via the second heat-source-side switching mechanism 5*b*, the accumulator 95, and the suction pipe 8. In this way, the second operation is performed.

(3-3) Third Operation

Next, the third operation is described in terms of three operations, that is, the third A operation, the third B operation, and the third C operation.

(3-3-1) Third A Operation

The 3 third A operation is an operation in which, although both a use-side heat exchanger that functions as an evaporator of a refrigerant and a use-side heat exchanger that functions as a radiator of a refrigerant exist, the load on an evaporation side is large as a whole (predominant cooling operation).

Figure 5:
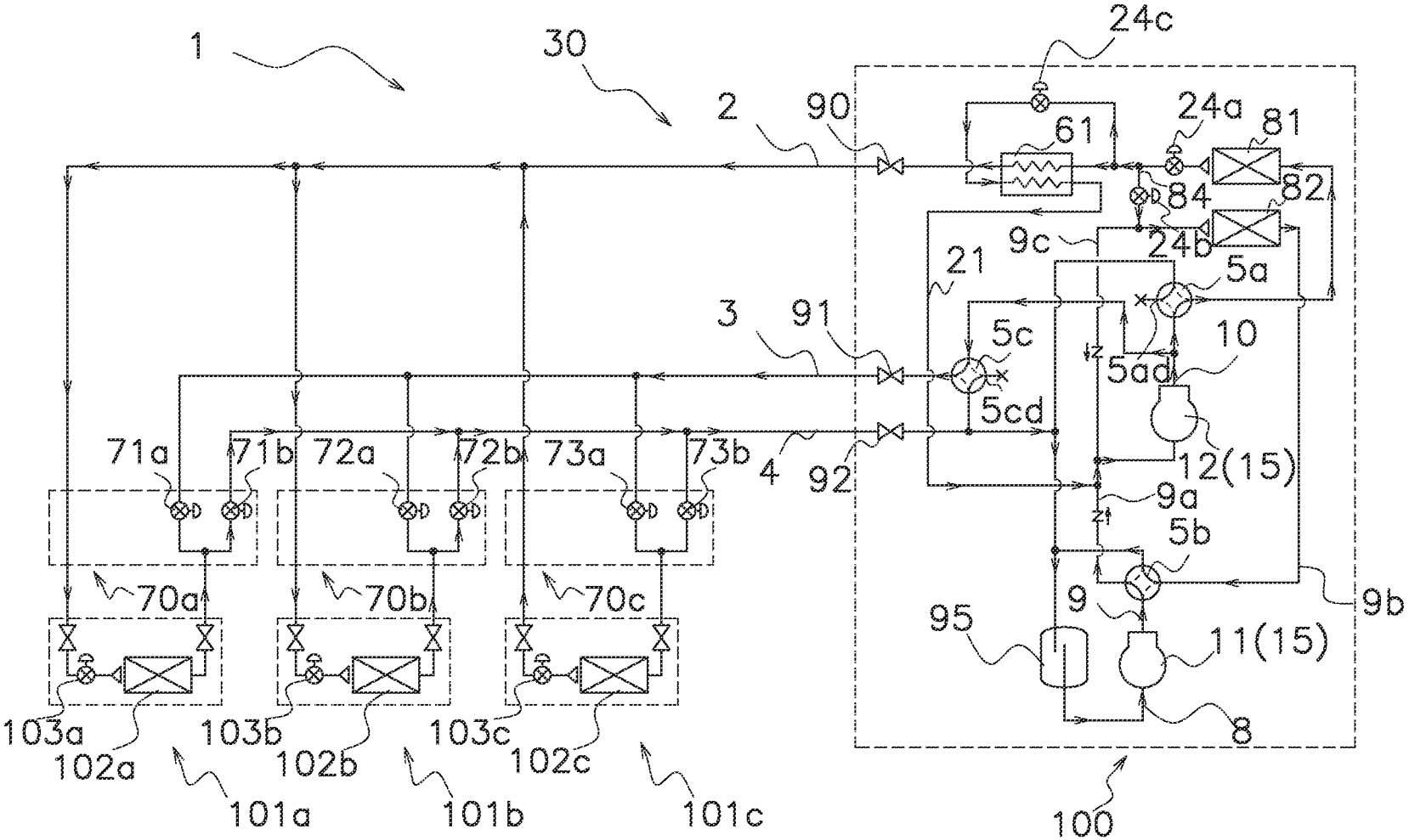
FIG. 5 is a schematic structural explanatory view of the operation of the air conditioner 1 when a third A operation is performed.

Here, operations that are performed when the third A operation is performed are described by giving as an example a case in which the control unit 120 causes the first use-side heat exchanger 102*a* and the second use-side heat exchanger 102*b* to function as evaporators of a refrigerant and perform a cooling operation and in which the control unit 120 causes the third use-side heat exchanger 102*c* to function as a radiator of a refrigerant and perform a heating operation (see FIG. 5).

In the third A operation, the control unit 120 determines that the first heat-source-side heat exchanger 81 is to function as a radiator and the second heat-source-side heat exchanger 82 is to function as an evaporator of a refrigerant. The control unit 120 switches the first heat-source-side switching mechanism 5*a* to a radiation operation state (state shown by the solid line of the first heat-source-side switching mechanism 5*a* in FIG. 5) and switches the second heat-source-side switching mechanism 5*b* and the third heat-source-side switching mechanism 5*c* to an evaporation operation state (state shown by the solid lines of the second heat-source-side switching mechanism 5*b* and the third heat-source-side switching mechanism 5*c* in FIG. 5). The control unit 120 closes the first branch-unit switching valves 71*a* and 72*a* and the second branch-unit switching valve 73*b* and opens the first branch-unit switching valve 73*a* and the second branch-unit switching valves 71*b* and 72*b*.

In such a state of the refrigerant circuit 30 (regarding flow of a refrigerant, see the arrows at the refrigerant circuit 30 of FIG. 5), a low-pressure refrigerant in a refrigeration cycle is sucked into the first compression unit 11 from the suction pipe 8. The low-pressure refrigerant in the refrigeration cycle that has been sucked into the first compression unit 11, after being compressed to an intermediate pressure in the refrigeration cycle at the first compression unit 11, is discharged to the intermediate connection pipe 9. The intermediate-pressure refrigerant in the refrigeration cycle that has been discharged to the intermediate connection pipe 9 from the first compression unit 11 flows through the first intermediate-connection-pipe branch pipe 9*a*, and is sent to the second compression unit 12. The intermediate-pressure refrigerant in the refrigeration cycle that has been sent to the second compression unit 12 is sucked into the second compression unit 12 and is compressed to a high pressure in the refrigeration cycle at the second compression unit 12. The refrigerant that has been compressed to a high pressure in the refrigeration cycle at the second compression unit 12 is discharged to the discharge pipe 10. Here, the high-pressure refrigerant in the refrigeration cycle that has been discharged to the discharge pipe 10 from the second compression unit 12 is compressed to a pressure that is higher than the critical pressure of the refrigerant by a double-stage compression operation by the compression units 11 and 12. A part of the high-pressure refrigerant in the refrigeration cycle that has been discharged to the discharge pipe 10 is sent to the first heat-source-side heat exchanger 81 via the liquid-refrigerant connection pipe 2 and the first heat-source-side switching mechanism 5*a* from the discharge pipe 10, and the remaining part is sent to the third use-side heat exchanger 102*c* via the high-low-pressure gas-refrigerant connection pipe 3 and the third heat-source-side switching mechanism 5*c*.

The high-pressure refrigerant in the refrigeration cycle that has been sent to the first heat-source-side heat exchanger 81 from the discharge pipe 10 exchanges heat with, for example, outdoor air and radiates at the first heat-source-side heat exchanger 81 that functions as a radiator of the refrigerant, and is sent to the first heat-source-side expansion mechanism 24*a*. The high-pressure refrigerant in the refrigeration cycle that has been sent to the first heat-source-side expansion mechanism 24*a* has its pressure reduced at the first heat-source-side expansion mechanism 24*a*. A part of the refrigerant whose pressure has been reduced at the first heat-source-side expansion mechanism 24*a* is sent to the economizer heat exchanger 61 via the liquid-refrigerant connection pipe 2, and the remaining part is sent to the second heat-source-side expansion mechanism 24*b*.

The refrigerant whose pressure has been reduced at the first heat-source-side expansion mechanism 24*a* and that has been sent to the second heat-source-side expansion mechanism 24*b* has its pressure reduced at the second heat-source-side expansion mechanism 24*b* and is sent to the second heat-source-side heat exchanger 82. The refrigerant that has been sent to the second heat-source-side heat exchanger 82, after evaporating at the second heat-source-side heat exchanger 82 that functions as an evaporator of the refrigerant, returns to the first compression unit 11 again via the second heat-source-side switching mechanism 5*b*, the accumulator 95, and the suction pipe 8.

A part of the refrigerant whose pressure has been reduced at the first heat-source-side expansion mechanism 24*a* and that has been sent to the economizer heat exchanger 61 via the liquid-refrigerant connection pipe 2 branches and flows in the economizer pipe 21.

The refrigerant that has branched and that has flowed in the economizer pipe 21 from the liquid-refrigerant connection pipe 2 has its pressure reduced to an intermediate pressure in the refrigeration cycle at the third heat-source-side expansion mechanism 24*c*, and is sent to the economizer heat exchanger 61. The refrigerant whose pressure has been reduced to an intermediate pressure in the refrigeration cycle at the third heat-source-side expansion mechanism 24*c* exchanges heat with the refrigerant that flows in the liquid-refrigerant connection pipe 2 at the economizer heat exchanger 61. The intermediate-pressure refrigerant in the refrigeration cycle that has exchanged heat with the refrigerant that flows in the liquid-refrigerant connection pipe 2 at the economizer heat exchanger 61 is sent to the first intermediate-connection-pipe branch pipe 9*a*. The intermediate-pressure refrigerant in the refrigeration cycle that has been sent to the first intermediate-connection-pipe branch pipe 9*a* is sucked into the second compression unit 12.

The refrigerant whose pressure has been reduced at the first heat-source-side expansion mechanism 24*a* and that has been sent to the economizer heat exchanger 61 via the liquid-refrigerant connection pipe 2 exchanges heat with the refrigerant that flows in the economizer pipe 21 and is cooled at the economizer heat exchanger 61. The refrigerant that has been cooled at the economizer heat exchanger 61 is sent to the use-side expansion mechanisms 103*a* and 103*b* via the liquid-refrigerant connection pipe 2.

On the other hand, the high-pressure refrigerant in the refrigeration cycle that has been sent to the third use-side heat exchanger 102*c* from the discharge pipe 10 exchanges heat with, for example, indoor air and radiates at the third use-side heat exchanger 102*c* that functions as a radiator of the refrigerant. The high-pressure refrigerant in the refrigeration cycle that has radiated at the third use-side heat exchanger 102*c* is sent to the third use-side expansion mechanism 103*c*. The high-pressure refrigerant in the refrigeration cycle that has been sent to the third use-side expansion mechanism 103*c* has its pressure reduced at the third use-side heat expansion mechanism 103*c*, and flows in the liquid-refrigerant connection pipe 2. The refrigerant that has flowed in the liquid-refrigerant connection pipe 2 merges with the refrigerant that has exchanged heat at the economizer heat exchanger 61. The refrigerant that has merged at the liquid-refrigerant connection pipe 2 is sent to the use-side expansion mechanisms 103*a* and 103*b*.

The refrigerant that has been sent to the use-side expansion mechanisms 103*a* and 103*b* has its pressure reduced and becomes a low-pressure refrigerant in a gas-liquid two-phase state in the refrigeration cycle at the use-side expansion mechanisms 103*a* and 103*b*. The low-pressure refrigerant in the refrigeration cycle whose pressure has been reduced at the use-side expansion mechanisms 103*a* and 103*b* is sent to the use-side heat exchangers 102*a* and 102*b*. The low-pressure refrigerant in the refrigeration cycle that has been sent to the use-side heat exchangers 102*a* and 102*b* exchanges heat with, for example, indoor air and evaporates at the use-side heat exchangers 102*a* and 102*b* that function as evaporators of the refrigerant. The low-pressure refrigerant in the refrigeration cycle that has evaporated at the use-side heat exchangers 102*a* and 102*b* is sucked into the first compression unit 11 again via the low-pressure gas-refrigerant connection pipe 4, the accumulator 95, and the suction pipe 8. In this way, the third A operation is performed.

(3-3-2) Third B Operation

Figure 6:
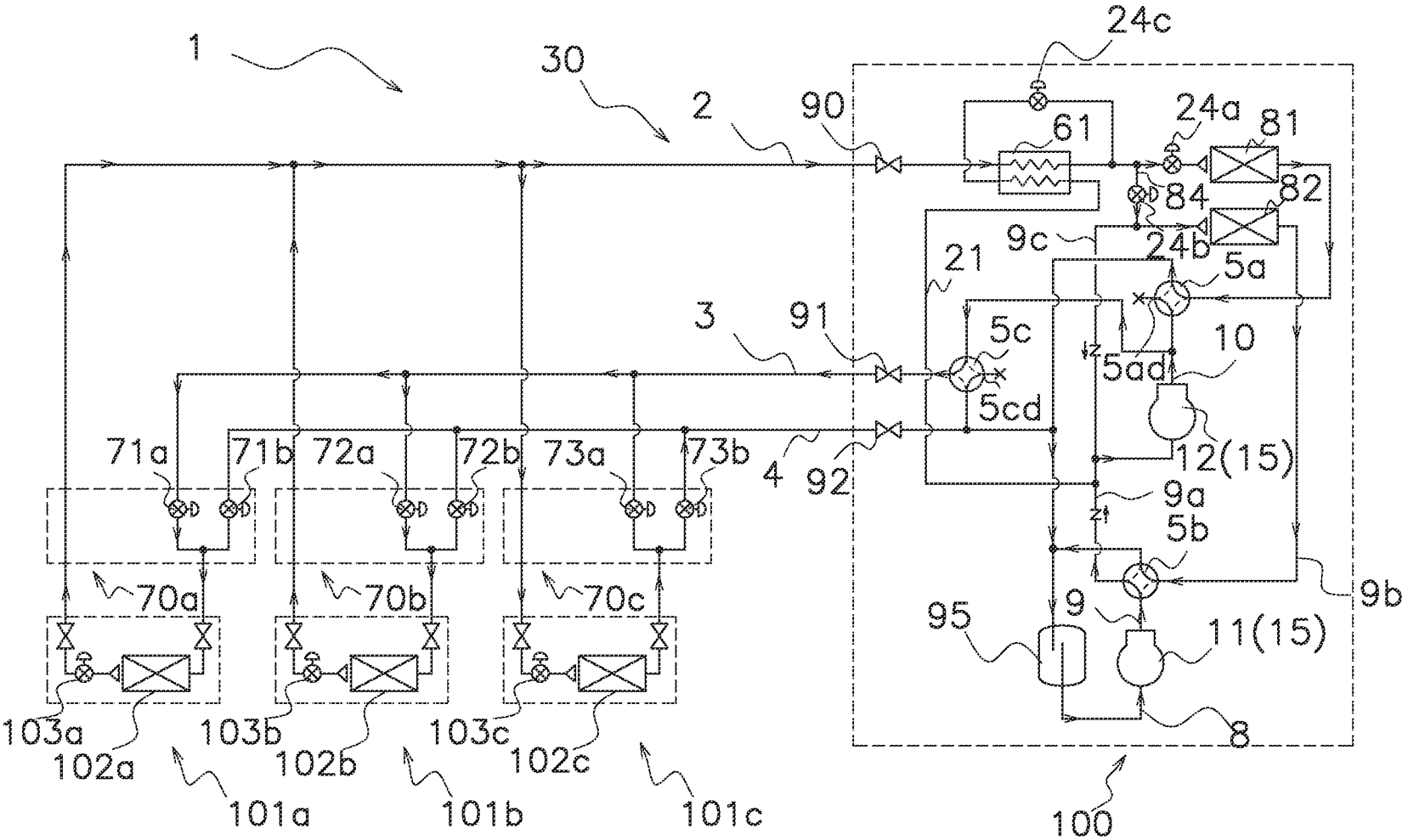
FIG. 6 is a schematic structural explanatory view of the operation of the air conditioner 1 when a third B operation is performed.

Here, operations that are performed when the third B operation is performed are described by giving as an example a case in which the control unit 120 causes the first use-side heat exchanger 102*a* and the second use-side heat exchanger 102*b* to function as radiators of a refrigerant and perform a heating operation and in which the control unit 120 causes the third use-side heat exchanger 102*c* to function as an evaporator of a refrigerant and perform a cooling operation (see FIG. 6).

In the third B operation, the control unit 120 determines that the first heat-source-side heat exchanger 81 and the second heat-source-side heat exchanger 82 are to function as evaporators of a refrigerant. The control unit 120 switches the first heat-source-side switching mechanism 5*a*, the second heat-source-side switching mechanism 5*b*, and the third heat-source-side switching mechanism 5*c* to an evaporation operation state (state shown by the solid lines of the first heat-source-side switching mechanism 5*a*, the second heat-source-side switching mechanism 5*b*, and the third heat-source-side switching mechanism 5*c* in FIG. 6). The control unit 120 closes the first branch-unit switching valve 73*a* and the second branch-unit switching valves 71*b* and 72*b*, and opens the first branch-unit switching valves 71*a* and 72*a* and the second branch-unit switching valve 73*b*.

In such a state of the refrigerant circuit 30 (regarding flow of a refrigerant, see the arrows at the refrigerant circuit 30 of FIG. 6), a low-pressure refrigerant in a refrigeration cycle is sucked into the first compression unit 11 from the suction pipe 8. The low-pressure refrigerant in the refrigeration cycle that has been sucked into the first compression unit 11, after being compressed to an intermediate pressure in the refrigeration cycle at the first compression unit 11, is discharged to the intermediate connection pipe 9. The intermediate-pressure refrigerant in the refrigeration cycle that has been discharged to the intermediate connection pipe 9 from the first compression unit 11 flows through the first intermediate-connection-pipe branch pipe 9*a* via the second heat-source-side switching mechanism 5*b*. The refrigerant that has flowed in the first intermediate-connection-pipe branch pipe 9*a* is sucked into the second compression unit 12, and, after being compressed to a high pressure in the refrigeration cycle at the second compression unit 12, is discharged to the discharge pipe 10. Here, the high-pressure refrigerant in the refrigeration cycle that has been discharged from the second compression unit 12 is compressed to a pressure that is higher than the critical pressure of the refrigerant by a double-stage compression operation by the compression units 11 and 12. The high-pressure refrigerant in the refrigeration cycle that has been discharged to the discharge pipe 10 is sent to the use-side heat exchangers 102*a* and 102*b* via the high-low-pressure gas-refrigerant connection pipe 3 and the third heat-source-side switching mechanism 5*c*. The high-pressure refrigerant in the refrigeration cycle that has been sent to the use-side heat exchangers 102*a* and 102*b* exchanges heat with, for example, indoor air and radiates at the use-side heat exchangers 102*a* and 102*b* that function as radiators of the refrigerant. The high-pressure refrigerant in the refrigeration cycle that has radiated at the use-side heat exchangers 102*a* and 102*b* is sent to the use-side expansion mechanisms 103*a* and 103*b*. The high-pressure refrigerant in the refrigeration cycle that has been sent to the use-side expansion mechanisms 103*a* and 103*b* has its pressure reduced at the use-side heat expansion mechanisms 103*a* and 103*b*. A part of the refrigerant whose pressure has been reduced at the use-side expansion mechanisms 103*a* and 103*b* is sent to the first heat-source-side expansion mechanism 24*a* and the second heat-source-side expansion mechanism 24*b* from the liquid-refrigerant connection pipe 2, and the remaining part is sent to the third use-side expansion mechanism 103*c* from the liquid-refrigerant connection pipe 2.

The refrigerant that has been sent to the first heat-source-side expansion mechanism 24*a* and the second heat-source-side expansion mechanism 24*b* has its pressure reduced and becomes a low-pressure refrigerant in a gas-liquid two-phase state in the refrigeration cycle at the first heat-source-side expansion mechanism 24*a* and the second heat-source-side expansion mechanism 24*b*. The low-pressure refrigerant in the refrigeration cycle whose pressure has been reduced at the first heat-source-side expansion mechanism 24*a* and the second heat-source-side expansion mechanism 24*b* is sent to the first heat-source-side heat exchanger 81 and the second heat-source-side heat exchanger 82 that function as evaporators of the refrigerant. The low-pressure refrigerant in the refrigeration cycle that has evaporated at the first heat-source-side heat exchanger 81 is sucked into the first compression unit 11 again via the first heat-source-side switching mechanism 5*a*, the accumulator 95, and the suction pipe 8. The low-pressure refrigerant in the refrigeration cycle that has evaporated at the second heat-source-side heat exchanger 82 is sucked into the first compression unit 11 again via the second heat-source-side switching mechanism 5*b*, the accumulator 95, and the suction pipe 8.

On the other hand, the refrigerant that has branched from the liquid-refrigerant connection pipe 2 and that has been sent to the third use-side expansion mechanism 103*c* has its pressure reduced and becomes a low-pressure refrigerant in a gas-liquid two-phase state in the refrigeration cycle at the third use-side expansion mechanisms 103*c*. The low-pressure refrigerant in the refrigeration cycle whose pressure has been reduced at the third use-side heat exchanger 103*c* is sent to the third use-side heat exchanger 102*c*. The low-pressure refrigerant in the refrigeration cycle that has been sent to the third use-side heat exchanger 102*c* exchanges heat with, for example, indoor air and evaporates at the third use-side heat exchanger 102*c* that functions as an evaporator of the refrigerant. The low-pressure refrigerant in the refrigeration cycle that has evaporated at the third use-side heat exchanger 102*c* is sent to the first compression unit 11 again via the low-pressure gas-refrigerant connection pipe 4, the accumulator 95, and the suction pipe 8.

(3-3-3) Third C Operation

Figure 7:
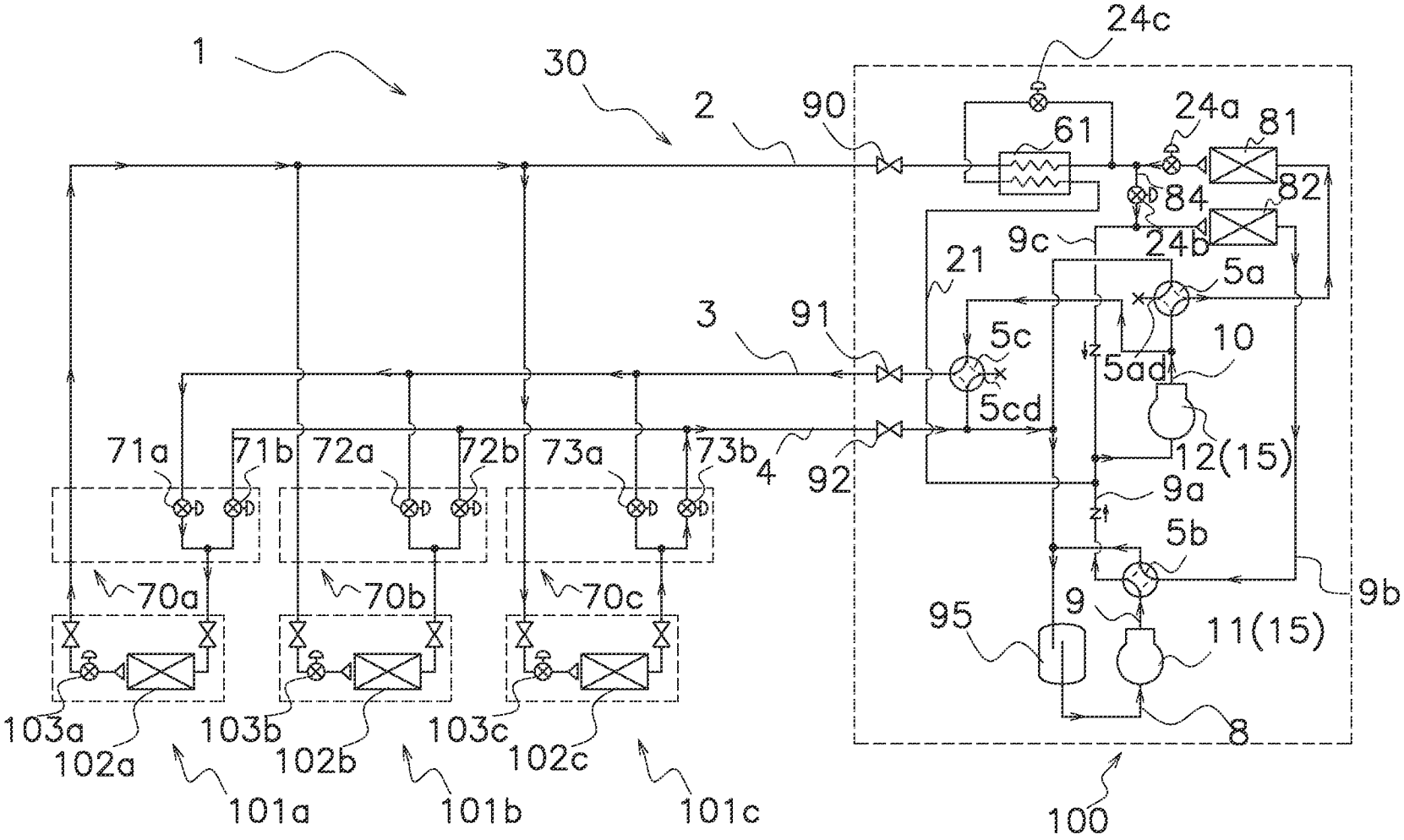
FIG. 7 is a schematic structural explanatory view of the operation of the air conditioner 1 when a third C operation is performed.

Here, operations that are performed when the third C operation is performed are described by giving as an example a case in which the control unit 120 causes the first use-side heat exchanger 102*a* to function as a radiator of a refrigerant and perform a heating operation, in which the control unit 120 causes the operation of the second use-side heat exchanger 102*b* to be stopped, and in which the control unit 120 causes the third use-side heat exchanger 102*c* to function as an evaporator of a refrigerant and perform a cooling operation (see FIG. 7).

In the third C operation, the control unit 120 determines that the first heat-source-side heat exchanger 81 is to function as a radiator of a refrigerant and the second heat-source-side heat exchanger 82 is to function as an evaporator of a refrigerant. The control unit 120 determines that the radiation load and the evaporation load of the respective first heat-source-side heat exchanger 81 and second heat-source-side heat exchanger 82 are small. The control unit 120 switches the first heat-source-side switching mechanism 5*a* to a radiation operation state shown by the solid line in FIG. 7 and switches the second heat-source-side switching mechanism 5*b* and the third heat-source-side switching mechanism 5*c* to an evaporation operation state shown by the solid lines in FIG. 7. The control unit 120 closes the first branch-unit switching valves 72*a* and 73*a* and the second branch-unit switching valves 71*b* and 72*b*, and opens the first branch-unit switching valve 71*a* and the second branch-unit switching valve 73*b*.

In such a state of the refrigerant circuit 30 (regarding flow of a refrigerant, see the arrows at the refrigerant circuit 30 of FIG. 7), a low-pressure refrigerant in a refrigeration cycle is sucked into the first compression unit 11 from the suction pipe 8. The low-pressure refrigerant in the refrigeration cycle that has been sucked into the first compression unit 11, after being compressed to an intermediate pressure in the refrigeration cycle at the first compression unit 11, is discharged to the intermediate connection pipe 9. The intermediate-pressure refrigerant in the refrigeration cycle that has been discharged from the first compression unit 11 is sent to the second compression unit 12 via the second heat-source-side switching mechanism 5*b*. The intermediate-pressure refrigerant in the refrigeration cycle that has been sent to the second compression unit 12 is compressed to a high pressure in the refrigeration cycle at the second compression unit 12, and is discharged to the discharge pipe 10. Here, the high-pressure refrigerant in the refrigeration cycle that has been discharged from the second compression unit 12 is compressed to a pressure that is higher than the critical pressure of the refrigerant by a double-stage compression operation by the compression units 11 and 12. A part of the high-pressure refrigerant in the refrigeration cycle that has been discharged to the discharge pipe 10 from the second compression unit 12 is sent to the first heat-source-side heat exchanger 81 via the first heat-source-side switching mechanism 5*a*, and the remaining part is sent to the first use-side heat exchanger 102*a* via the third heat-source-side switching mechanism 5*c*.

The high-pressure refrigerant in the refrigeration cycle that has been sent to the first heat-source-side heat exchanger 81 via the first heat-source-side switching mechanism 5*a* exchanges heat with, for example, outdoor air and radiates at the first heat-source-side heat exchanger 81 that functions as a radiator of the refrigerant. The high-pressure refrigerant in the refrigeration cycle that has radiated at the first heat-source-side heat exchanger 81 has its pressure reduced at the first heat-source-side expansion mechanism 24*a*. The refrigerant whose pressure has been reduced at the first heat-source-side expansion mechanism 24*a* is sent to the second heat-source-side expansion mechanism 24*b*. The refrigerant that has been sent to the second heat-source-side expansion mechanism 24*b* has its pressure reduced and becomes a low-pressure refrigerant in a gas-liquid two-phase state in the refrigeration cycle at the second heat-source-side expansion mechanism 24*b*. The low-pressure refrigerant in the refrigeration cycle whose pressure has been reduced at the second heat-source-side expansion mechanism 24*b* is sent to the second heat-source-side heat exchanger 82. The low-pressure refrigerant in the refrigeration cycle that has been sent to the second heat-source-side heat exchanger 82 exchanges heat with, for example, outdoor air and evaporates at the second heat-source-side heat exchanger 82 that functions as an evaporator of the refrigerant. The low-pressure refrigerant in the refrigeration cycle that has evaporated at the second heat-source-side heat exchanger 82 is sucked into the first compression unit 11 again via the second heat-source-side switching mechanism 5*b*, the accumulator 95, and the suction pipe 8.

On the other hand, the high-pressure refrigerant in the refrigeration cycle that has been sent to the first use-side heat exchanger 102*a* from the discharge pipe 10 exchanges heat with, for example, indoor air and radiates at the first use-side heat exchanger 102*a* that functions as a radiator of the refrigerant. The high-pressure refrigerant in the refrigeration cycle that has radiated at the first use-side heat exchanger 102*a* is sent to the first use-side expansion mechanism 103*a*.

The high-pressure refrigerant in the refrigeration cycle that has been sent to the use-side expansion mechanism 103*a* has its pressure reduced at the first use-side expansion mechanism 103*a*. The refrigerant whose pressure has been reduced at the first use-side expansion mechanism 103*a* is sent to the third use-side expansion mechanism 103*c* via the liquid-refrigerant connection pipe 2. The refrigerant that has been sent to the third use-side expansion mechanism 103*c* has its pressure reduced and becomes a low-pressure refrigerant in a gas-liquid two-phase state in the refrigeration cycle at the third use-side expansion mechanism 103*c*. The low-pressure refrigerant whose pressure has been reduced at the third use-side expansion mechanism 103*c* is sent to the third use-side heat exchanger 102*c*. The low-pressure refrigerant in the refrigeration cycle that has been sent to the third use-side heat exchanger 102*c* exchanges heat with, for example, indoor air and evaporates at the third use-side heat exchanger 102*c* that functions as an evaporator of the refrigerant. The low-pressure refrigerant in the refrigeration cycle that has evaporated at the third use-side heat exchanger 102*c* is sucked into the first compression unit 11 again via the low-pressure gas-refrigerant connection pipe 4, the accumulator 95, and the suction pipe 8. In this way, the third C operation is performed.

(4) Modifications

Next, modifications of the air conditioner 1 according to the present embodiment are described. Note that structures that are the same as those of the first embodiment above are given the same reference numerals and detailed descriptions thereof are omitted.

(4-1) Modification 1A

Figure 8:
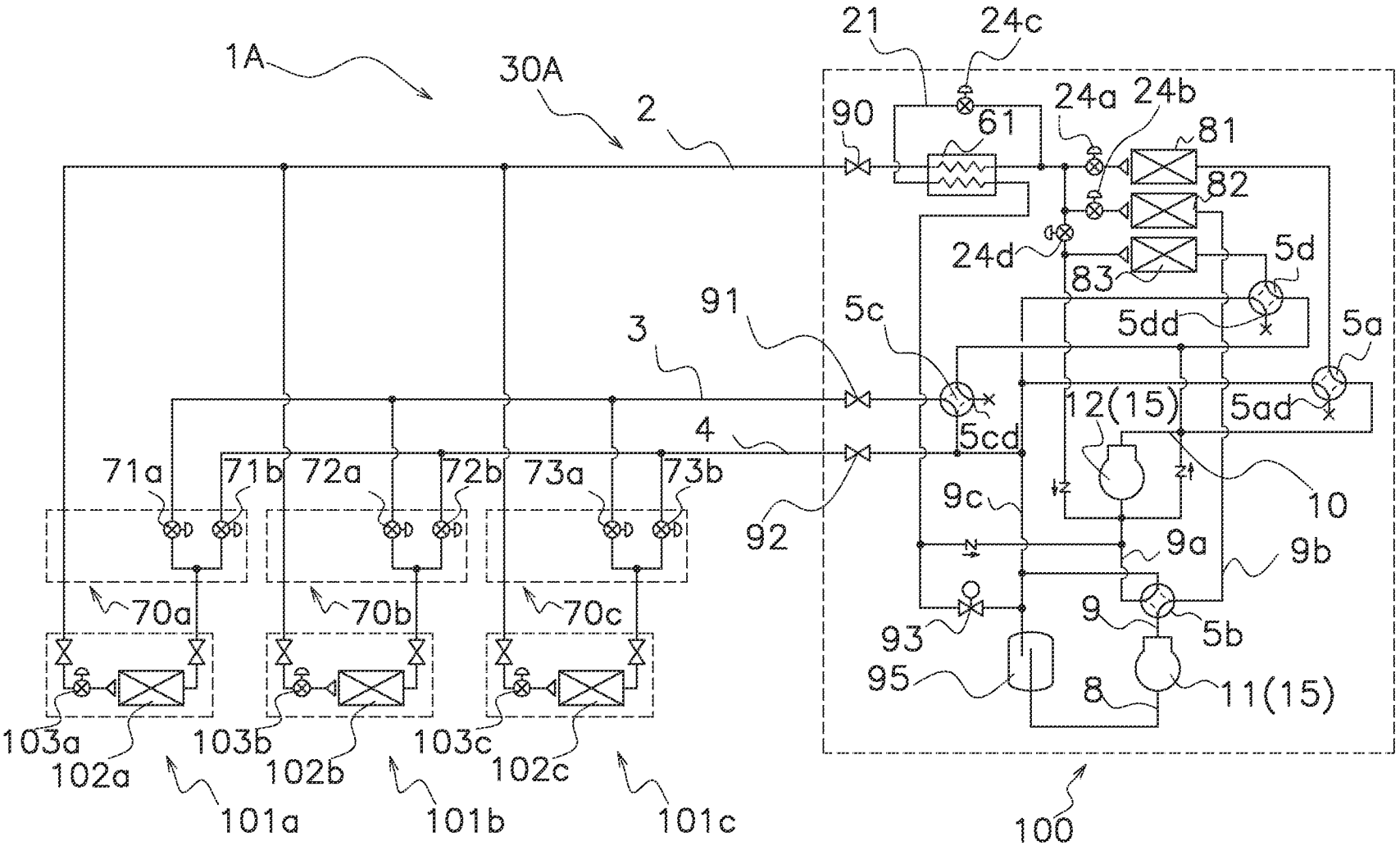
FIG. 8 is a schematic structural view of an air conditioner 1A according to Modification 1A.
Figure 9:
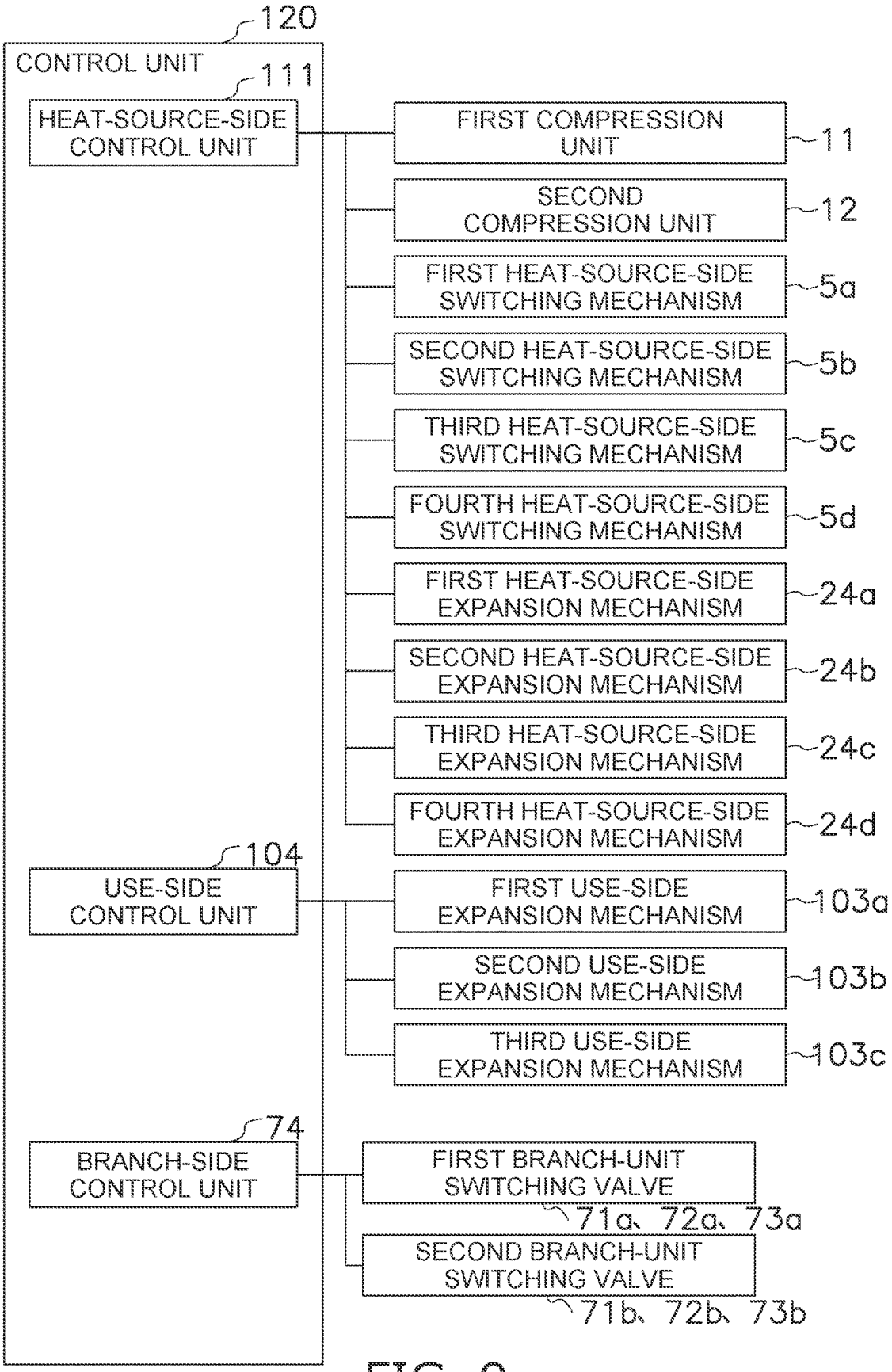
FIG. 9 is a block diagram of a control unit 120 according to Modification 1A.

In the above embodiment, the heat-source-side unit 100 of the air conditioner 1 is described as having a first heat-source-side heat exchanger 81 and a second heat-source-side heat exchanger 82. However, the structure of the air conditioner 1 is not limited thereto, and, for example, in an air conditioner 1A, a heat-source-side heat exchanger may be divided into a first heat-source-side heat exchanger 81, a second heat-source-side heat exchanger 82, and a third heat-source-side heat exchanger 83 (see FIGS. 8 and 9).

In this case, a refrigerant circuit 30A of the air conditioner 1A further has a fourth heat-source-side switching mechanism 5*d*, a fourth heat-source-side expansion mechanism 24*d*, and a third gas-side cutout valve 93.

The fourth heat-source-side switching mechanism 5*d* is a mechanism for switching a direction of flow of a refrigerant in the refrigerant circuit 30A. More specifically, the control unit 120 is a mechanism for switching between a radiation operation state and an evaporation operation state. The radiation operation state is a state in which the control unit 120 causes the first heat-source-side heat exchanger 81 to function as a radiator of a refrigerant, the second heat-source-side heat exchanger 82 to function as an intermediate cooler or a radiator of a refrigerant, and the third heat-source-side heat exchanger 83 to function as a radiator of a refrigerant. The evaporation operation state is a state in which the control unit 120 causes the first heat-source-side heat exchanger 81, the second heat-source-side heat exchanger 82, and the third heat-source-side heat exchanger 83 to function as evaporators of a refrigerant.

Here, the fourth heat-source-side switching mechanism 5*d* is a four-way switching valve. A fourth port 5*dd* of the fourth heat-source-side switching mechanism 5*d* is closed, and the fourth heat-source-side switching mechanism 5*d* functions as a three-way valve.

The fourth heat-source-side expansion mechanism 24*d* is a mechanism that is disposed at the refrigerant circuit 30A and that expands a refrigerant that flows between the use-side heat exchangers 102*a*, 102*b*, and 102*c* and the heat-source-side heat exchangers 81, 82, and 83. Here, the fourth heat-source-side expansion mechanism 24*d* is constituted by an electric expansion valve whose opening degree can be adjusted. The opening degree of the fourth heat-source-side expansion mechanism 24*d* is adjusted as appropriate by the control unit 120 in accordance with an operation state.

(4-2) Modification 1B

In the above embodiment, the first heat-source-side switching mechanism 5*a*, the second heat-source-side switching mechanism 5*b*, the third heat-source-side switching mechanism 5*c*, and the fourth heat-source-side switching mechanism 5*d* are each described as being a four-way switching valve. However, in the present disclosure, four-way switching valves do not necessarily need to be used as flow-path switching valves. For example, other types of switching valves, such as electromagnetic valves, electric valves, three-way valves, or five-way valves, may be used as the flow-path switching valves.

(5) Features (5-1)

In an air conditioner that includes a compression mechanism including a plurality of compression units, a heat-source-side heat exchanger that is divided to function as an evaporator or a radiator, and use-side units, and that is constituted to be capable of performing switching between a cooling operation and a heating operation for each use-side unit, increasing operation efficiency by cooling a refrigerant that is compressed by the plurality of compression units by a heat exchanger that functions as an intermediate cooler may be considered. In particular, in an air conditioner that performs a supercritical refrigeration cycle in which the pressure becomes higher than the critical pressure of a refrigerant, since the temperature of the refrigerant that is discharged from the compression mechanism is increased, reducing the temperature of the refrigerant that is discharged from the compression mechanism by cooling the refrigerant with an intermediate cooler may be considered. However, when a heat-source-side heat exchanger that is divided to function as an evaporator or a radiator is further divided to form a heat exchanger that functions as an intermediate cooler, costs are increased. In the air conditioner 1 of the first embodiment of the present disclosure, the second heat-source-side heat exchanger 82 that functions as an intermediate cooler at the time of the first operation functions as an evaporator of a refrigerant at the time of the second operation and the third operation. In this way, one heat exchanger is constituted to function as an intermediate cooler or an evaporator in accordance with an instruction of the control unit 120. Therefore, since it is no longer necessary to further divide a heat-source-side heat exchanger to form a heat exchanger that functions as an intermediate cooler, an increase in costs is suppressed.

(5-2)

The air conditioner 1 of the first embodiment according to the present disclosure may have a first heat-source-side heat exchanger 81, a second heat-source-side heat exchanger 82, and a third heat-source-side heat exchanger 83 by dividing a heat-source-side heat exchanger. By dividing the heat-source-side heat exchanger in this way, the heat-source-side heat exchanger is capable of properly processing the heat loads of the use-side units.

Even in the air conditioner 1A having a third heat-source-side heat exchanger by further dividing a heat-source-side heat exchanger, increasing operation efficiency by cooling a refrigerant that is compressed by the plurality of compression units with a heat exchanger that functions as an intermediate cooler may be considered. The air conditioner 1A according to the first embodiment of the present disclosure is such that the second heat-source-side heat exchanger 82 functions as an intermediate cooler or an evaporator in accordance with an instruction of the control unit 120. Therefore, since it is no longer necessary to further divide a heat-source-side heat exchanger to form a heat exchanger that functions as an intermediate cooler, an increase in costs is suppressed.

Second Embodiment

Figure 10:
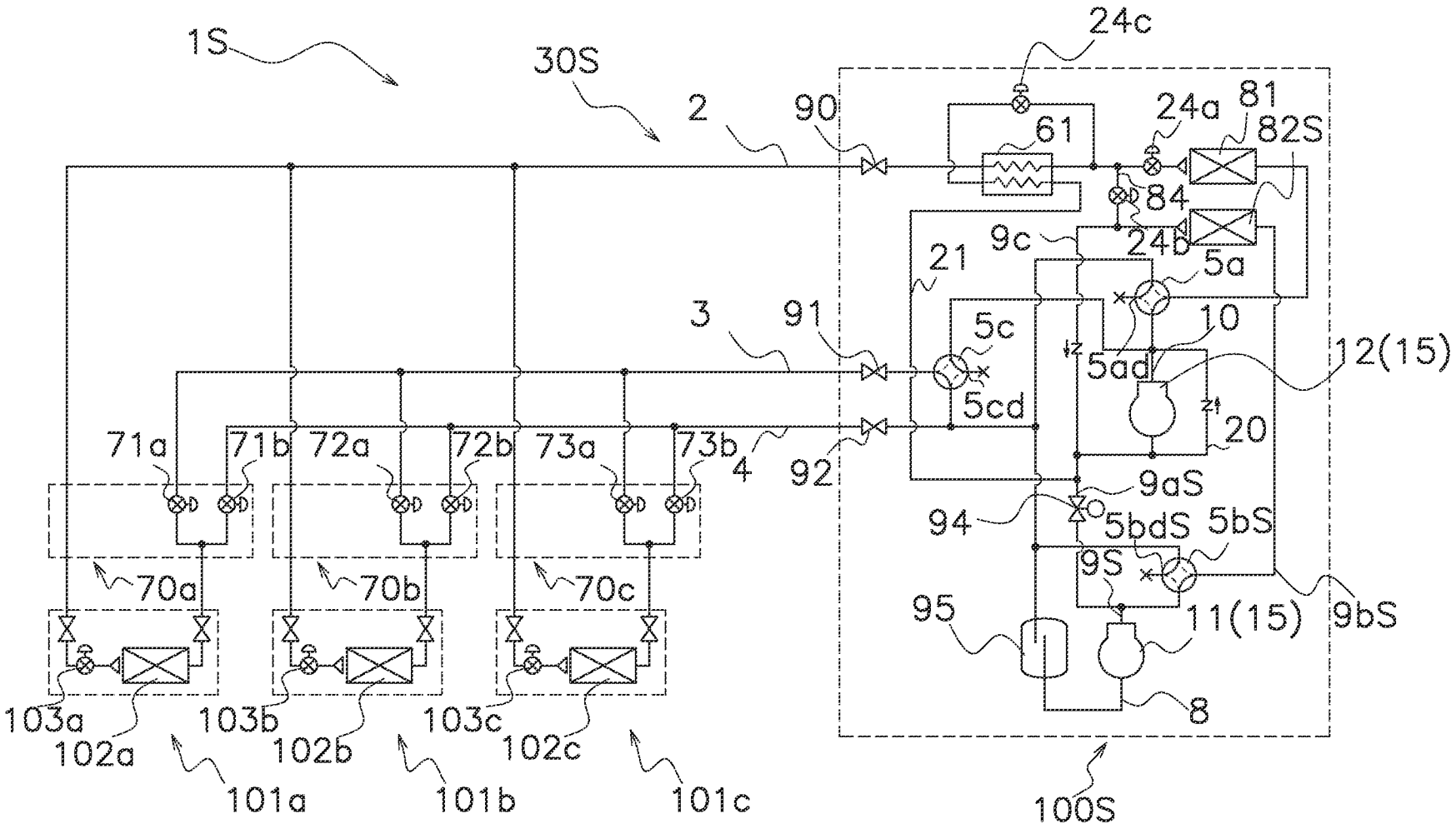
FIG. 10 is a schematic structural view of an air conditioner 1S according to second embodiment of the present disclosure.

Next, an air conditioner 1S as a second embodiment of the present disclosure is described. Note that, in order to distinguish this embodiment from the other embodiment, in the present embodiment, the letter "S" is sometimes added. The air conditioner 1 according to the first embodiment has been described as including a second heat-source-side heat exchanger 82 that functions as an intermediate cooler of a refrigerant and an evaporator of a refrigerant. As shown in FIG. 10, the second embodiment differs from the first embodiment in that a heat-source-side unit 100S has a bypass pipe 20. Excluding this point, the structure of the second embodiment is substantially the same as the structure of the first embodiment. Therefore, in the second embodiment, structures differing from those of the first embodiment are described, and the other descriptions are omitted.

(6) Detailed Structure (6-1) Intermediate Connection Pipe

An intermediate connection pipe 9S is a pipe to which is discharged a refrigerant that has been compressed to a high pressure in a refrigeration cycle at a first compression unit 11, and that branches into a first intermediate-connection-pipe branch pipe 9*a*S and a second intermediate-connection-pipe branch pipe 9*b*S. The second intermediate-connection-pipe branch pipe 9*b*S is a pipe that connects the intermediate connection pipe 9S and a second heat-source-side heat exchanger 82S to each other via a second heat-source-side switching mechanism 5*b*S. The first intermediate-connection-pipe branch pipe 9*a*S is a pipe that connects the intermediate connection pipe 9S and a second compression unit 12 to each other.

(6-2) Heat-Source-Side Unit

The heat-source-side unit 100S is installed on the roof of, for example, a building, or around, for example, a building. The heat-source-side unit 100S is connected to use-side units 101*a*, 101*b*, and 101*c* via a liquid-refrigerant connection pipe 2, a high-low-pressure gas-refrigerant connection pipe 3, a low-pressure gas-refrigerant connection pipe 4, a liquid-side cutout valve 90, a first gas-side cutout valve 91, a second gas-side cutout valve 92, a fifth gas-side cutout valve 94, and respective branch units 70*a*, 70*b*, and 70*c*, and constitutes a part of a refrigerant circuit 30S.

The heat-source-side unit 100S primarily has a first heat-source-side heat exchanger 81, the second heat-source-side heat exchanger 82S, an injection pipe 9*c* for sending to a suction side of the second compression unit 12 a refrigerant that has flowed in the second heat-source-side heat exchanger 82S, an economizer pipe 21, an economizer heat exchanger 61, a first heat-source-side expansion mechanism 24*a*, a second heat-source-side expansion mechanism 24*b*, a first heat-source-side switching mechanism 5*a*, the second heat-source-side switching mechanism 5*b*S, a third heat-source-side switching mechanism 5*c*, and the bypass pipe 20.

(6-2-1)

The second heat-source-side heat exchanger 82S is a heat exchanger that functions as an intermediate cooler, an evaporator, or a radiator of a refrigerant. The second heat-source-side heat exchanger 82S is connected to the second heat-source-side switching mechanism 5*b*S by the second intermediate-connection-pipe branch pipe 9*b*S. A liquid side of the first heat-source-side heat exchanger 81 and a liquid side of the second heat-source-side heat exchanger 82S are connected to each other via a liquid-refrigerant-connection-pipe branch pipe 84.

A fourth port 5*bd*S of the second heat-source-side switching mechanism 5*b*S is closed, and the second heat-source-side switching mechanism 5*b*S is a four-way switching valve that functions as a three-way valve. Note that the second heat-source-side switching mechanism 5*bs* may be a three-way valve instead of a four-way switching valve.

The bypass pipe 20 is a pipe that branches off from the first intermediate-connection-pipe branch pipe 9*a*S and that is connected to a discharge pipe 10. A refrigerant that has been discharged to the second intermediate-connection-pipe branch pipe 9*b*S from the first compression unit 11 and that has flowed in the first intermediate-connection-pipe branch pipe 9*a*S passes through the bypass pipe 20 to flow in the use-side units 101*a*, 101*b*, and 101*c*, or the first heat-source-side heat exchanger 81 without being sucked into the second compression unit 12.

A control unit 120 controls the operations of devices of each part that constitutes the air conditioner 1S. The air conditioner 15 is capable of performing switching between a first S operation, a second S operation, and a third S operation, which are described below, by control of the control unit 120.

(7) Operation of Air Conditioner

Next, the operation of the air conditioner 15 according to the present embodiment is described. The air conditioner 15 according to the present embodiment conditions air due to the control unit 120 performs switching between the second S operation and the third S operation.

The second S operation is an operation in which only use-side heat exchangers that function as radiators of a refrigerant (use-side units that perform a heating operation) exist (all heating operation).

The third S operation is an operation in which a use-side unit that performs a cooling operation and a use-side unit that performs a heating operation exist (simultaneous cooling-and-heating operation).

(7-1) Second S Operation

Figure 11:
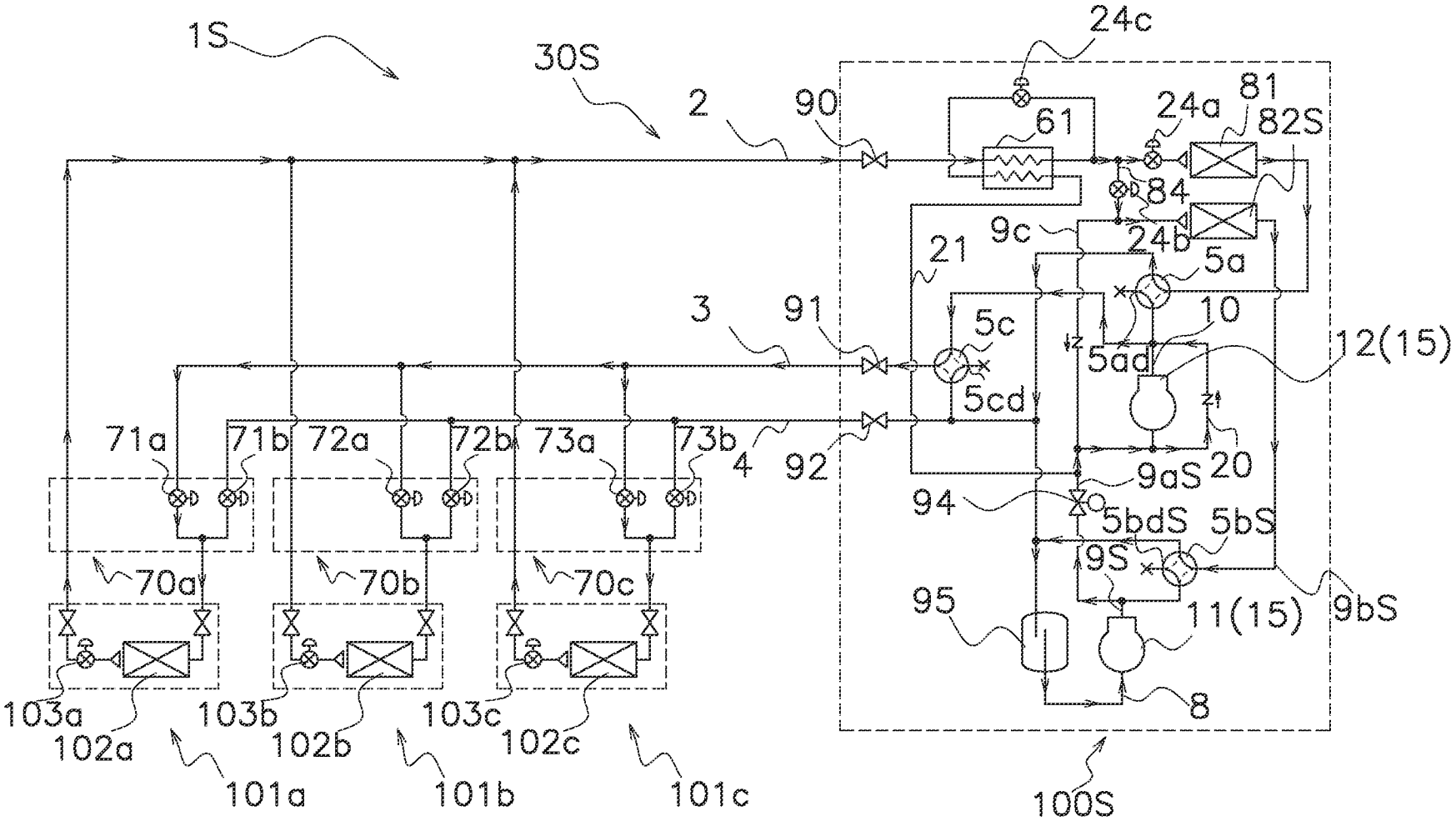
FIG. 11 is a schematic structural explanatory view of the operation of the air conditioner 15 when a second S operation is performed.

Here, operations that are performed when the second S operation is performed are described by giving as an example a case in which the control unit 120 causes the first use-side heat exchanger 102*a* and the third use-side heat exchanger 102*c* to function as radiators of a refrigerant and perform a heating operation and in which the control unit 120 causes the operation of the second use-side heat exchanger 102*b* to be stopped (see FIG. 11).

In the second S operation, the control unit 120 determines that the first heat-source-side heat exchanger 81 and the second heat-source-side heat exchanger 82S are to function as evaporators of a refrigerant. The control unit 120 switches the first heat-source-side switching mechanism 5*a*, the second heat-source-side switching mechanism 5*b*S, and the third heat-source-side switching mechanism 5*c* to an evaporation operation state (state shown by the solid lines of the first heat-source-side switching mechanism 5*a*, the second heat-source-side switching mechanism 5*b*S, and the third heat-source-side switching mechanism 5*c* in FIG. 11). The control unit 120 closes a first branch-unit switching valve 72*a* and second branch-unit switching valves 71*b*, 72*b*, and 73*b* and opens first branch-unit switching valves 71*a* and 73*a*.

In such a state of the refrigerant circuit 30S (regarding flow of a refrigerant, see the arrows at the refrigerant circuit 30S of FIG. 11), a low-pressure refrigerant in a refrigeration cycle is sucked into the first compression unit 11 from the suction pipe 8. The low-pressure refrigerant in the refrigeration cycle that has been sucked into the first compression unit 11, after being compressed to a high pressure in the refrigeration cycle at the first compression unit 11, is discharged to the intermediate connection pipe 9S. Here, the high-pressure refrigerant in the refrigeration cycle that has been discharged to the intermediate connection pipe 9S from the first compression unit 11 is compressed to a pressure that is higher than the critical pressure of the refrigerant by a compression operation by the first compression unit 11. The high-pressure refrigerant in the refrigeration cycle that has been discharged to the intermediate connection pipe 9S from the first compression unit 11 flows through the first intermediate-connection-pipe branch pipe 9*a*S, and flows in the bypass pipe 20. The high-pressure refrigerant in the refrigeration cycle that has flowed in the bypass pipe 20 is sent to the use-side heat exchangers 102*a* and 102*c* via the high-low-pressure gas-refrigerant connection pipe 3 and the third heat-source-side switching mechanism 5*c*. The high-pressure refrigerant in the refrigeration cycle that has been sent to the use-side heat exchangers 102*a* and 102*c* exchanges heat with, for example, indoor air and radiates at the use-side heat exchangers 102*a* and 102*c* that function as radiators of the refrigerant. The high-pressure refrigerant in the refrigeration cycle that has radiated at the use-side heat exchangers 102*a* and 102*c* is sent to the use-side expansion mechanisms 103*a* and 103*c*. The high-pressure refrigerant in the refrigeration cycle that has been sent to the use-side expansion mechanisms 103*a* and 103*c* has its pressure reduced at the use-side heat expansion mechanisms 103*a* and 103*c*. The refrigerant whose pressure has been reduced at the use-side expansion mechanisms 103*a* and 103*c* is sent to the first heat-source-side expansion mechanism 24*a* and the second heat-source-side expansion mechanism 24*b* via the liquid-refrigerant connection pipe 2 or the liquid-refrigerant connection-pipe branch pipe 84. The refrigerant that has been sent to the first heat-source-side expansion mechanism 24*a* and the second heat-source-side expansion mechanism 24*b* has its pressure reduced and becomes a low-pressure refrigerant in a gas-liquid two-phase state in the refrigeration cycle at the first heat-source-side expansion mechanism 24*a* and the second heat-source-side expansion mechanism 24*b*. The low-pressure refrigerant in the refrigeration cycle whose pressure has been reduced at the first heat-source-side expansion mechanism 24*a* and the second heat-source-side expansion mechanism 24*b* is sent to the respective first heat-source-side heat exchanger 81 and second heat-source-side heat exchanger 82S. The low-pressure refrigerant in the refrigeration cycle that has been sent to the first heat-source-side heat exchanger 81 and the second heat-source-side heat exchanger 82S exchanges heat with, for example, outdoor air and evaporates at the first heat-source-side heat exchanger 81 and second heat-source-side heat exchanger 82S that function as evaporators of the refrigerant. The low-pressure refrigerant in the refrigeration cycle that has evaporated at the first heat-source-side heat exchanger 81 is sucked into the first compression unit 11 again via the first heat-source-side switching mechanism 5*a*, an accumulator 95, and the suction pipe 8. The low-pressure refrigerant in the refrigeration cycle that has evaporated at the second heat-source-side heat exchanger 82S is sucked into the first compression unit 11 again via the second heat-source-side switching mechanism 5*b*S, the accumulator 95, and the suction pipe 8. In this way, the second S operation is performed.

(7-2) Third S Operation

Next, the third S operation is described. Here, as an example of the third S operation, a description is given of a case in which, although both a use-side heat exchanger that functions as a radiator of a refrigerant and a use-side heat exchanger that functions as an evaporator of a refrigerant exist, an operation (predominant heating operation) in which the load on a radiation side is large as a whole is performed.

Figure 12:
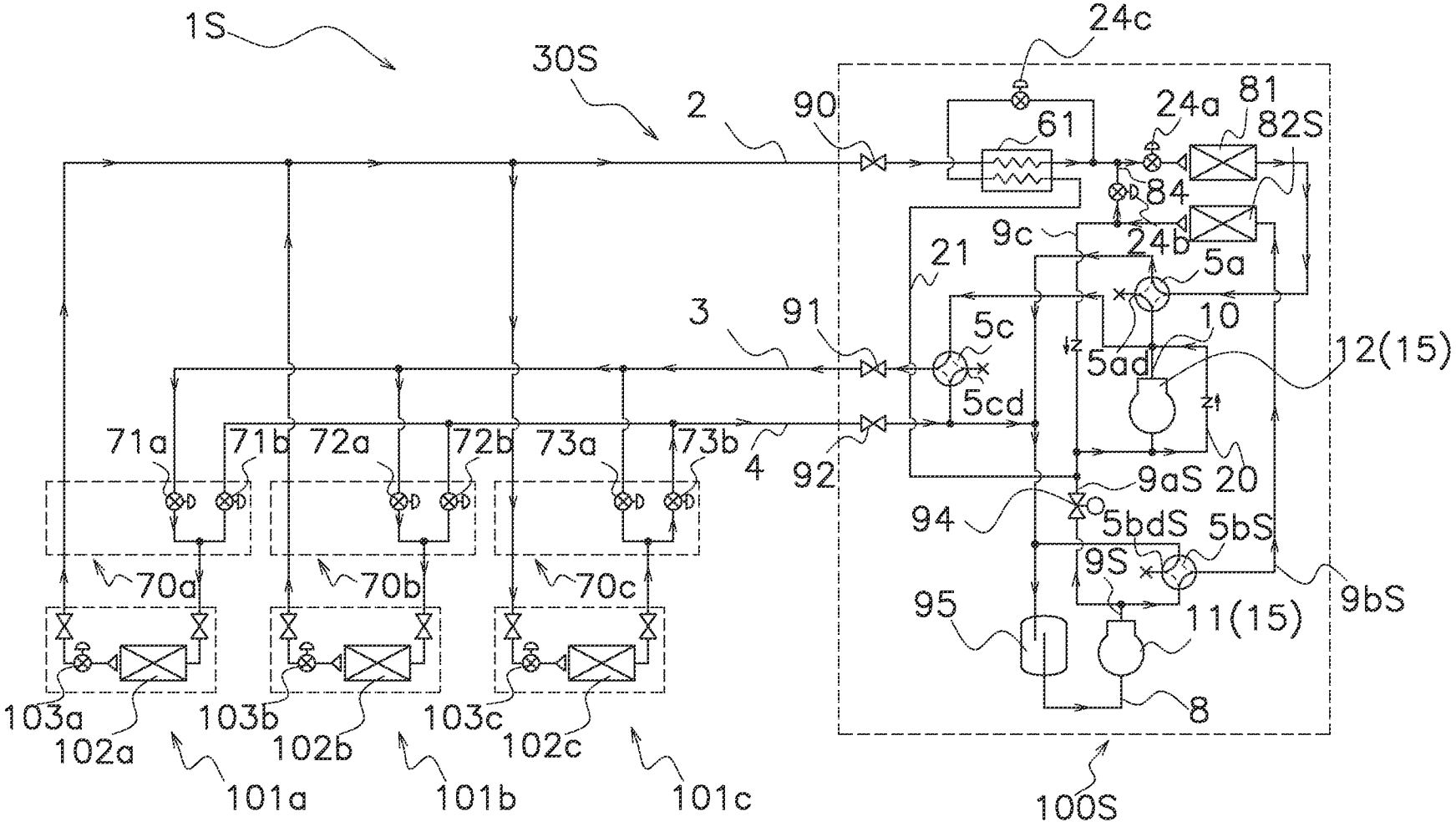
FIG. 12 is a schematic structural explanatory view of the operation of the air conditioner 15 when a third S operation is performed.

Here, as an example of the predominant heating operation, a description is given of a case in which the control unit 120 causes the first use-side heat exchanger 102*a* and the second use-side heat exchanger 102*b* to function as radiators of a refrigerant and perform a heating operation and in which the control unit 120 causes the third use-side heat exchanger 102*c* to function as an evaporator of a refrigerant and perform a cooling operation (see FIG. 12).

In such an operation, the control unit 120 determines that the first heat-source-side heat exchanger 81 is to function as an evaporator and the second heat-source-side heat exchanger 82S is to function as a radiator of a refrigerant. The control unit 120 switches the second heat-source-side switching mechanism 5*bs* to a radiation operation state shown by the solid line in FIG. 12 and switches the first heat-source-side switching mechanism 5*a* and the third heat-source-side switching mechanism 5*c* to an evaporation operation state shown by the solid lines in FIG. 12. The control unit 120 closes the first branch-unit switching valve 73*a* and the second branch-unit switching valves 71*b* and 72*b*, and opens the first branch-unit switching valves 71*a* and 72*a* and the second branch-unit switching valve 73*b*.

In such a state of the refrigerant circuit 30S (regarding flow of a refrigerant, see the arrows at the refrigerant circuit 30S of FIG. 12), a low-pressure refrigerant in a refrigeration cycle is sucked into the first compression unit 11 from the suction pipe 8. The low-pressure refrigerant in the refrigeration cycle that has been sucked into the first compression unit 11, after being compressed to a high pressure in the refrigeration cycle at the first compression unit 11, is discharged to the intermediate connection pipe 9S. Here, the high-pressure refrigerant in the refrigeration cycle that has been discharged to the intermediate connection pipe 9S from the first compression unit 11 is compressed to a pressure that is higher than the critical pressure of the refrigerant by a compression operation by the first compression unit 11. The high-pressure refrigerant in the refrigeration cycle that has been discharged to the intermediate connection pipe 9S from the first compression unit 11 branches and flows through the second intermediate-connection-pipe branch pipe 9*b*S and the first intermediate-connection-pipe branch pipe 9*a*S.

The high-pressure refrigerant in the refrigeration cycle that has flowed in the second intermediate-connection-pipe branch pipe 9*b*S from the intermediate connection pipe 9S is sent to the second heat-source-side heat exchanger 82S that functions as a radiator of the refrigerant, and exchanges heat with, for example, outdoor air and radiates at the second heat-source-side heat exchanger 82S. The high-pressure refrigerant in the refrigeration cycle that has radiated at the second heat-source-side heat exchanger 82S has its pressure reduced at the second heat-source-side expansion mechanism 24*b*, and is sent to the first heat-source-side expansion mechanism 24*a*. The refrigerant that has been sent to the first heat-source-side expansion mechanism 24*a* has its pressure reduced at the first heat-source-side expansion mechanism 24*a*, and becomes a low-pressure refrigerant in the refrigeration cycle. The low-pressure refrigerant in the refrigeration cycle whose pressure has been reduced at the first heat-source-side expansion mechanism 24*a* is sent to the first heat-source-side heat exchanger 81. The low-pressure refrigerant in the refrigeration cycle that has been sent to the first heat-source-side heat exchanger 81 exchanges heat with, for example, outdoor air and evaporates at the first heat-source-side heat exchanger 81 that functions as an evaporator of the refrigerant. The low-pressure refrigerant in the refrigeration cycle that has evaporated at the first heat-source-side heat exchanger 81 is sucked into the first compression unit 11 again via the first heat-source-side switching mechanism 5*a*, the accumulator 95, and the suction pipe 8.

On the other hand, the refrigerant that has flowed to the first intermediate-connection-pipe branch pipe 9*a*S from the intermediate connection pipe 9S flows in the bypass pipe 20. The high-pressure refrigerant in the refrigeration cycle that has flowed in the bypass pipe 20 is sent to the use-side heat exchangers 102*a* and 102*c* via the high-low-pressure gas-refrigerant connection pipe 3 and the third heat-source-side switching mechanism 5*c*. The high-pressure refrigerant in the refrigeration cycle that has been sent to the use-side heat exchangers 102*a* and 102*b* exchanges heat with, for example, indoor air and radiates at the use-side heat exchangers 102*a* and 102*b* that function as radiators of the refrigerant. The high-pressure refrigerant in the refrigeration cycle that has radiated at the use-side heat exchangers 102*a* and 102*b* is sent to the use-side expansion mechanisms 103*a* and 103*b*. The high-pressure refrigerant in the refrigeration cycle that has been sent to the use-side expansion mechanisms 103*a* and 103*b* has its pressure reduced at the use-side heat expansion mechanisms 103*a* and 103*b*. A part of the refrigerant whose pressure has been reduced at the use-side expansion mechanisms 103*a* and 103*b* is sent to the first heat-source-side expansion mechanism 24*a* from the liquid-refrigerant connection pipe 2, and the remaining part is sent to the third use-side expansion mechanism 103*c* from the liquid-refrigerant connection pipe 2.

The refrigerant that has been sent to the first heat-source-side expansion mechanism 24*a* has its pressure reduced and becomes a low-pressure refrigerant in a gas-liquid two-phase state in the refrigeration cycle at the first heat-source-side expansion mechanism 24*a*. The low-pressure refrigerant in the refrigeration cycle whose pressure has been reduced at the first heat-source-side expansion mechanism 24*a* is sent to the first heat-source-side heat exchanger 81. The low-pressure refrigerant in the refrigeration cycle that has evaporated at the first heat-source-side heat exchanger 81 that functions as an evaporator is sucked into the first compression unit 11 again via the first heat-source-side switching mechanism 5*a*, the accumulator 95, and the suction pipe 8.

The refrigerant that has branched from the liquid-refrigerant connection pipe 2 and that has been sent to the third use-side expansion mechanism 103*c* has its pressure reduced and becomes a low-pressure refrigerant in a gas-liquid two-phase state in the refrigeration cycle at the third use-side expansion mechanism 103*c*. The low-pressure refrigerant in the refrigeration cycle whose pressure has been reduced at the third use-side heat exchanger 103*c* is sent to the third use-side heat exchanger 102*c*. The low-pressure refrigerant in the refrigeration cycle that has been sent to the third use-side heat exchanger 102*c* exchanges heat with, for example, indoor air and evaporates at the third use-side heat exchanger 102*c* that functions as an evaporator of the refrigerant. The low-pressure refrigerant in the refrigeration cycle that has evaporated at the third use-side heat exchanger 102*c* is sent to the first compression unit 11 via the low-pressure gas-refrigerant connection pipe 4, the accumulator 95, and the suction pipe 8. In this way, the predominant heating operation, which is an example of the third S operation, is performed.

(8) Features of Second Embodiment (8-1)

In an air conditioner that includes a compression mechanism including a plurality of compression units, a heat-source-side heat exchanger that is divided to function as an evaporator or a radiator, and a plurality of use-side units, and that is constituted to be capable of performing switching between a cooling operation and a heating operation for each use-side unit, increasing operation efficiency by cooling a refrigerant that is compressed by the plurality of compression units by a heat exchanger that functions as an intermediate cooler may be considered. In particular, in an air conditioner that performs a supercritical refrigeration cycle in which the pressure becomes higher than the critical pressure of a refrigerant, since the temperature of the refrigerant that is discharged from the compression mechanism is increased, reducing the temperature of the refrigerant that is discharged from the compression mechanism by cooling the refrigerant with an intermediate cooler may be considered. However, when a heat-source-side heat exchanger that is divided to function as an evaporator or a radiator is further divided to form a heat exchanger that functions as an intermediate cooler, costs are increased. In the air conditioner 1*s* according to the second embodiment of the present disclosure, the second heat-source-side heat exchanger 82S that functions as an intermediate cooler at the time of the first operation functions as an evaporator of a refrigerant or a radiator of a refrigerant at the time of the second operation or the third operation. In this way, since one heat exchanger functions as an intermediate cooler, an evaporator, or a radiator in accordance with an instruction of the control unit 120, it is no longer necessary to further divide a heat-source-side heat exchanger into a heat exchanger that functions as an intermediate cooler. Therefore, an increase in costs is suppressed.

(8-2)

The second heat-source-side heat exchanger 82 of the first embodiment above functions as an evaporator of a refrigerant and as an intermediate cooler of a refrigerant. In general, when a heat-source-side heat exchanger is to be divided into a radiator and an evaporator, the heat-source-side heat exchanger is divided so that the proportion of the evaporator is small. Even in the present disclosure, the second heat-source-side heat exchanger 82 that functions as an evaporator and as an intermediate cooler is divided so that the size proportion is smaller than that of the first heat-source-side heat exchanger 81.

Although both a use-side heat exchanger that functions as a radiator of a refrigerant and a use-side heat exchanger that functions as an evaporator of a refrigerant exist, when an operation in which the load on a radiation side is large as a whole (predominant heating operation) is to be performed, a heat-source-side heat exchanger needs to process predominantly the load on the radiation side. In such a case, when, as in the third B operation of the first embodiment, the second heat-source-side heat exchanger 82 that has been divided so that the size proportion is smaller than that of the first heat-source-side heat exchanger 81 processes the load on the radiation side, the operation efficiency may be reduced.

The air conditioner 1S according to the second embodiment of the present disclosure has a bypass pipe 20 for bypassing the second compression unit 12. Therefore, the second heat-source-side heat exchanger 82S functions as a radiator of a high-pressure refrigerant in a refrigeration cycle. Consequently, since the air conditioner 15 is such that the second heat-source-side heat exchanger 82S that is smaller than the first heat-source-side heat exchanger 81 is capable of functioning as a radiator, it is possible to suppress a reduction in operation efficiency when the predominant heating operation is performed.

Although the embodiments of the present disclosure have been described above, it is to be understood that various changes can be made to the forms and details without departing from the spirit and the scope of the present disclosure described in the claims. The present disclosure is one that allows various disclosures to be provided by combining as appropriate a plurality of structural elements that are disclosed in each of the embodiments above. For example, some of the structural elements may be omitted from all of the structural elements that are described in each of the embodiments. Further, structural elements of different embodiments may be combined as appropriate.

REFERENCE SIGNS LIST

1, 1A, 1S air conditioner
2 liquid-refrigerant connection pipe
3 high-low-pressure gas-refrigerant connection pipe
4 low-pressure gas-refrigerant connection pipe
10 discharge pipe
11 first compression unit
12 second compression unit
15 compression mechanism
20 bypass pipe
21 economizer pipe
61 economizer heat exchanger
70*a*, 70*b*, 70*c* branch unit
81 first heat-source-side heat exchanger
82, 82S second heat-source-side heat exchanger
83 third heat-source-side heat exchanger
100 heat-source-side unit
101*a*, 101*b*, 101*c* use-side unit
120 control unit

CITATION LIST

Patent Literature

PTL 1: Japanese Unexamined Patent Application Publication No. 2016-11780

The invention claimed is:

1. An air conditioner comprising:

a compression mechanism that has a first compressor and a second compressor that is disposed on a discharge side of the first compressor, a heat-source-side unit that has a first heat-source-side heat exchanger and a second heat-source-side heat exchanger;

a plurality of use-side units, each switching between a cooling operation and a heating operation; and a controller that performs switching between a first operation, a second operation, a third operation by switching a flow of a refrigerant at the heat-source-side unit, wherein the controller, at a time of the first operation, switches the flow of the refrigerant so that the first heat-source-side heat exchanger functions as a radiator and the second heat-source-side heat exchanger functions as an intermediate cooler, wherein the controller, at a time of the second operation, switches the flow of the refrigerant so that the first heat-source-side heat exchanger and the second heat-source-side heat exchanger function as evaporators, wherein, at a time of the third operation, the controller switches the flow of the refrigerant so that the first heat-source-side heat exchanger functions as the radiator and the second heat-source-side heat exchanger functions as the evaporator, or the controller switches the flow of the refrigerant so that the first heat-source-side heat exchanger functions as the evaporator and the second heat-source-side heat exchanger functions as a radiator, wherein the heat-source-side unit further has an economizer pipe that causes a part of a refrigerant that is to be sent to the plurality of use-side units from the first heat-source-side heat exchanger to branch and to be sent to a suction side of the second compression unit, and an economizer heat exchanger that causes the refrigerant that is to be sent to the use-side units from the first heat-source-side heat exchanger and the refrigerant that flows in the economizer pipe to exchange heat with each other, and wherein the economizer pipe branches between the first heat-source-side heat exchanger and the economizer heat exchanger.

2. The air conditioner according to claim 1, wherein the heat-source-side unit further has a pipe that sends to a suction side of the second compressor a refrigerant that flows in the second heat-source-side heat exchanger that functions as the intermediate cooler.

3. The air conditioner according to claim 1, wherein the heat-source-side unit further has a bypass pipe for bypassing the second compressor.

4. The air conditioner according to claim 1, wherein the heat-source-side unit further has a third heat-source-side heat exchanger, wherein the controller, at the time of the first operation, switches the flow of the refrigerant so that the first heat-source-side heat exchanger functions as the radiator, the second heat-source-side heat exchanger functions as the intermediate cooler, and the third heat-source-side heat exchanger functions as a radiator, wherein the controller, at the time of the second operation, switches the flow of the refrigerant so that the first heat-source-side heat exchanger and the second heat-source-side heat exchanger function as the evaporators, and the third heat-source-side heat exchanger functions as an evaporator, and wherein, at the time of the third operation, the controller switches the flow of the refrigerant so that, of the first heat-source-side heat exchanger, the second heat-source-side heat exchanger, and the third heat-source-side heat exchanger, two heat exchangers function as the evaporators, and one remaining heat exchanger functions as the radiator, or the controller switches the flow of the refrigerant so that, of the first heat-source-side heat exchanger, the second heat-source-side heat exchanger, and the third heat-source-side heat exchanger, two heat exchangers function as the radiators, and one remaining heat exchanger functions as the evaporator.

5. The air conditioner according to claim 1, wherein a supercritical refrigeration cycle in which a pressure of a refrigerant that is discharged from the compression mechanism becomes a pressure that is higher than a critical pressure of the refrigerant is performed.

6. The air conditioner according to claim 1, wherein the refrigerant is a $CO_2$ refrigerant or a $CO_2$ mixed refrigerant.

7. The air conditioner according to claim 2, wherein the heat-source-side unit further has a bypass pipe for bypassing the second compressor.

8. The air conditioner according to claim 2, wherein a supercritical refrigeration cycle in which a pressure of a refrigerant that is discharged from the compression mechanism becomes a pressure that is higher than a critical pressure of the refrigerant is performed.

9. The air conditioner according to claim 3, wherein a supercritical refrigeration cycle in which a pressure of a refrigerant that is discharged from the compression mechanism becomes a pressure that is higher than a critical pressure of the refrigerant is performed.

10. The air conditioner according to claim 4, wherein a supercritical refrigeration cycle in which a pressure of a refrigerant that is discharged from the compression mechanism becomes a pressure that is higher than a critical pressure of the refrigerant is performed.

11. The air conditioner according to claim 2, wherein the refrigerant is a $CO_2$ refrigerant or a $CO_2$ mixed refrigerant.

12. The air conditioner according to claim 3, wherein the refrigerant is a $CO_2$ refrigerant or a $CO_2$ mixed refrigerant.

13. The air conditioner according to claim 4, wherein the refrigerant is a $CO_2$ refrigerant or a $CO_2$ mixed refrigerant.

14. The air conditioner according to claim 5, wherein the refrigerant is a $CO_2$ refrigerant or a $CO_2$ mixed refrigerant.

* * * * *